US005380630A

United States Patent [19]

Mochizuki et al.

[11] Patent Number: 5,380,630

[45] Date of Patent: Jan. 10, 1995

[54] SILVER HALIDE PHOTOGRAPHIC PRODUCT

[75] Inventors: Yoshihiro Mochizuki; Eiichi Ueda; Toshiyuki Ikariya, all of Hino, Japan

[73] Assignee: Konica Corporation, Japan

[21] Appl. No.: 201,075

[22] Filed: Feb. 24, 1994

Related U.S. Application Data

[63] Continuation of Ser. No. 891,837, Jun. 1, 1992, abandoned.

[30] Foreign Application Priority Data

Jun. 3, 1991 [JP] Japan ..... 3-160070

[51] Int. Cl.[6] ..... G03C 1/76; G03C 3/00

[52] U.S. Cl. ..... 430/501; 430/523; 430/961

[58] Field of Search ..... 430/501, 523, 961

[56] References Cited

U.S. PATENT DOCUMENTS

| | | | |
|---|---|---|---|
| 4,004,927 | 1/1977 | Yamamoto et al. | 430/523 |
| 4,866,469 | 9/1989 | Shiba et al. | 354/202 |
| 5,063,147 | 11/1991 | Yoneyama et al. | 430/523 |

FOREIGN PATENT DOCUMENTS

| | | | |
|---|---|---|---|
| 395107 | 10/1990 | European Pat. Off. . | |
| 420127 | 4/1991 | European Pat. Off. . | |
| 0466417 | 1/1992 | European Pat. Off. | 430/501 |
| 2245011 | 4/1975 | France . | |
| 2-287540 | 11/1990 | Japan | 430/961 |
| 2-294636 | 12/1990 | Japan | 430/523 |

OTHER PUBLICATIONS

Patent Abstracts of Japan, vol. 14, No. 64 (P-1002) Feb. 6, 1990, JPA-1-287,553; Nov. 20, 1989.

*Primary Examiner*—Charles L. Bowers, Jr.
*Assistant Examiner*—Mark F. Huff
*Attorney, Agent, or Firm*—Jordan B. Bierman

[57] ABSTRACT

Disclosed is a color photographic product having a patrone and a silver halide color photographic material rolled in said patrone, which said silver halide color photographic material comprises;

a support having a thickness of 90 μm or less, a backing layer on a first face of said support, a silver halide emulsion layer and a protective layer on a second face of said support, wherein each outermost layer on said first and second face has a coefficient of kinetic friction of 0.33 or less with respect to a velvet attached to an opening of said patrone and said opening has a gap of 0.5 to 2.9 mm.

A silver halide photographic light-sensitive material according to this invention is improved in flaw resistance, image sharpness and film abrasion resistance.

18 Claims, No Drawings

SILVER HALIDE PHOTOGRAPHIC PRODUCT

This application is a continuation, of application number 07,891,837, filed Jun. 1, 1992, now abandoned.

FIELD OF THE INVENTION

This invention relates to a silver halide photographic light sensitive material suitable for a compact-sized camera convenient for photographing and handling and, particularly, to a silver halide photographic light sensitive material capable of making it thin-layered and improved in flaw resistance, image sharpness and film abrasion resistance.

BACKGROUND OF THE INVENTION

For taking pictures on a trip for example, a small, pocket-sized camera has been put into practical use, because the camera can be ready to take pictures and convenient for handling and portability. On the other hand, cameras using a 35 mm rollfilm are large in volume, heavy in weight and inconvenient for portability. Therefore, small-sized cameras such as a 110-size camera and a disk camera have been developed as portable cameras. With these cameras, however, the resulting image quality is deteriorated because the exposed image areas are also small-sized as the cameras are getting small-sized. The image quality deterioration is against the users' requirements for high image quality and is not acceptable by users.

For satisfying an excellent portability and a high image quality each required by users, a camera has been required to make it smaller in size without sacrificing an exposed image area. Therefore, it has been an essential theme to make a 35 mm-size film cartridge smaller in size.

The proportion of the volume of a light sensitive material occupying in a film cartridge is considerably larger. It is, therefore, an effective means for reducing the volume of the light sensitive material to make the film cartridge smaller. In the meanwhile, the volume of the light sensitive material depends upon the layer thickness of the light sensitive material, because the most portions of the layer thickness of the light sensitive material are occupied by a support. Therefore, the attempts have been tried to reduce the volume of a light sensitive material by making the support thickness thinner so as to make a cartridge smaller in size. However, there has raised a new problem that many scratches are produced on a film in the course of taking pictures and carrying out a development. There is also another problem as film abrasion resistance is seriously deteriorated when film is wound inside a camera. Further, the users' requirements for providing a high image quality cannot be satisfied, because an image sharpness is also deteriorated in practical photographing operation.

SUMMARY OF THE INVENTION

This invention was achieved to solve the above-described problems. It is, therefore, an object of the invention to provide a photographic light sensitive material convenient for handling, excellent in flaw resistance and image sharpness and less in film abrasion when winding up a film.

The above-mentioned object of the invention can be achieved with a silver halide photographic light sensitive material comprising a support provided thereto with at least one of silver halide emulsion layers, a backing layer and a protective layer; wherein the support thickness is not thicker than 90 μm, the kinematic friction coefficient is not more than 0.33 to the velvet of the outermost layer of the backing layers and the kinematic friction coefficient is not more than 0.33 to the velvet of the outermost layer on the side provided with the silver halide emulsion layers.

In the above-mentioned case, it is preferred to contain organopolysiloxane in the outermost layer of the protective layers on the emulsion layer side and also to contain a compound having Formula (1) or (2) given below in the backing layer.

Formula (1)

RCOOM wherein R represents an aliphatic hydrocarbon group and M represents an cation.

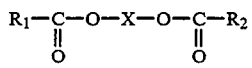

Formula (2)

wherein $R_1$ and $R_2$ represent each an aliphatic hydrocarbon group and X represents a divalent linkage group.

It is further preferred to contain organopolysiloxane in the outermost layer of the protective layers on the emulsion layer side and to contain a compound represented by Formula (1) or (2) given above in the outermost layer of the backing layers.

DETAILED DESCRIPTION OF THE INVENTION

The invention will now be detailed below.

In the silver halide photographic light sensitive material of the invention, the support applicable thereto may have a thickness of not thicker than 90 μm and within the range of, desirably, 50 to 90 μm and, preferably, 60 to 80 μm.

The kinetic friction coefficient of the silver halide photographic light sensitive material of the invention may be not more than 0.33 and within the range of, desirably not less than 0.10 to not more than 0.30 and, preferably not less than 0.12 to not more than 0.25 to the velvet of the outermost backing layers from the support and the velvet of the outermost silver halide emulsion layer from the support.

The term, 'a kinetic friction coefficient to a velvet' herein means a kinetic friction coefficient when sliding the surface on the side of the emulsion layer of a sample on the surface of the backing layer of the sample with applying a load of 100 g to a needle attached with a 1 cm-square Nylon-made velvet to the point of the needle; provided, the test is to be tried under the conditions of 23° C. and 55%RH.

With regard to a shape of a cartridge having thereon a velvet, how pile of the velvet is woven, height of the pile and material thereof, they are disclosed in Japanese Patent Publication Open to Public Inspection Nos. 276132/1989, 65036/1987 and 27734/1987 (hereinafter referred to as Japanese Patent O.P.I. Publication). Dimensions of the cartridge slit that is a gateway for a film, in particular, are disclosed in Japanese Patent O.P.I. Publication No. 276132/1989.

The organopolysiloxane applicable to the invention include, for example, the compounds given in U.S. Pat. Nos. 3,042,522, 3,080,317 and 2,694,637; Japanese Patent Examined Publication (hereinafter referred to as JP-EP) No. 39-15714/1964; British Patent Nos.

1,030,811, 1,143,118, 1,526,656, 1,275,657, 1,278,402 and 1,313,384; Japanese patent Examined Publication Nos. 51-15740/1976, 45-34230/1970 and 46-27428/1971; Japanese Patent Publication Open to Public Inspection (hereinafter referred to as JP-OPI Publication) No.49-62128/1974; and JP-EP Nos. 49-62127/1964, 53-292/1978 and 55-49294/1980; JP-OPI Publication Nos. 60-140341/1985, 60-140342/1985, 60-140343/1985, 60-188945/1985, 60-231704/1985, 60-231720/1985, 60-240761/1985, 60-243167/1985, 60-240732/1985, 60-245638/1985, 61-216/1986, 61-232/1986 and 61-260/1986. In the invention, the preferable compounds among them include those having the structural unit represented by the following formula (3).

Formula (3)

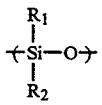

wherein $R_1$ represents a hydrogen atom, a hydroxyl group or an organic group and $R_2$ represents an organic group.

The organic groups represented by $R_1$ and $R_2$ preferably include, for example, the following groups, namely, an alkyl group (preferably including those having each 1 to 18 carbon atoms), a substituted alkyl group {e.g., a carboxyalkyl group, an aminoalkyl group, an alkylaminoalkyl group, a mercaptoalkyl group, an alkoxyalkyl group, a glycidyloxyalkyl group, an aralkyl group, an aryloxyalkyl group, and $-R_3-R_4-R_5-$ group (in which $R_3$ represents an alkylene group, $R_4$ represents a group linked to not less than two oxyalkylene groups and $R_5$ represents an alkyl group}, an alkenyl group (e.g., a vinyl group and an allyl group), an alkoxy group (e.g., a methoxy group and an ethoxy group), an aromatic group (e.g., a phenyl group) and a group containing the above groups.

The terminals of the organopolysiloxane are preferable to have a structural unit having the following formula (4).

Formula (4)

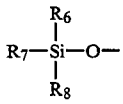

wherein $R_6$, $R_7$ and $R_8$ represent each a hydrogen atom, a hydroxyl group or an organic group and the organic groups include, for example, those given for $R_1$ and $R_2$.

There is no special limitation to the viscosity of the organopolysiloxane applicable to the invention. However, the viscosity thereof measured at 25° C. is usually suitable to show a viscosity within the range 20 to 100000 centistokes. The polysiloxane is suitable to have a molecular weight within the range of 1000 to 1000000. When it is within the abovementioned range, it may be used to meet the purposes. However, it is preferably within the range of 2000 to 50000.

Next, the typical compounds applicable to the invention will be given below.

Exemplified compounds A

A-1

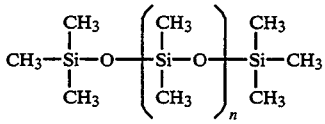

n = 370

A-2

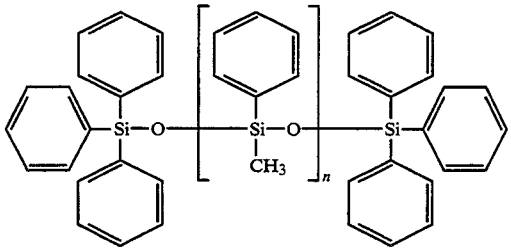

n = 10

A-3

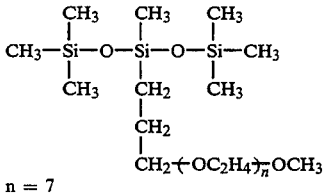

n = 7

A-4

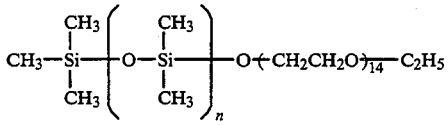

n = 5

A-5

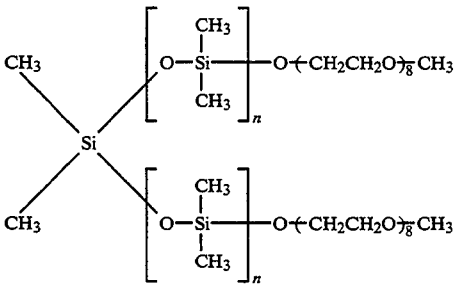

n = 2

A-6

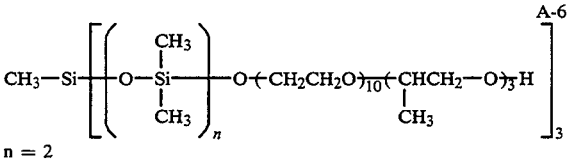

n = 2

-continued
A-7
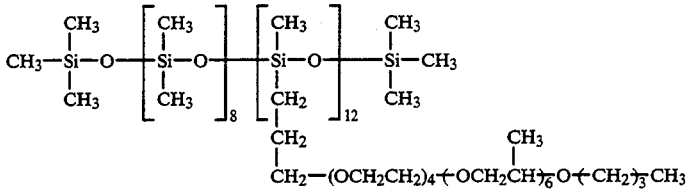
A-8
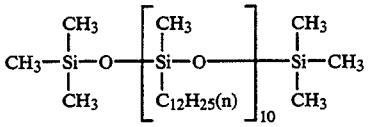
A-9
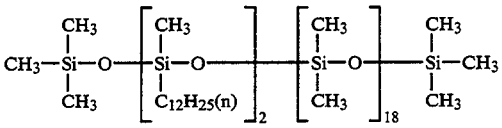
A-10
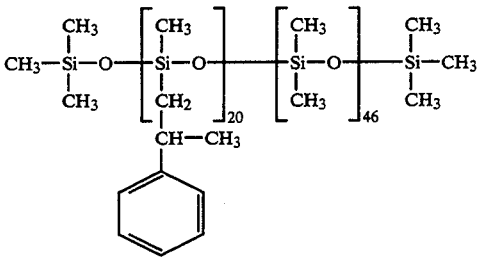
A-11
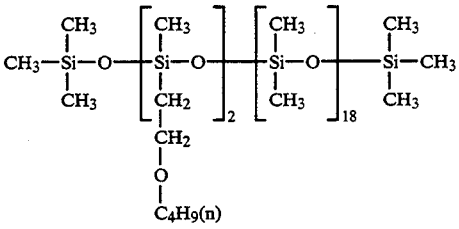
A-12
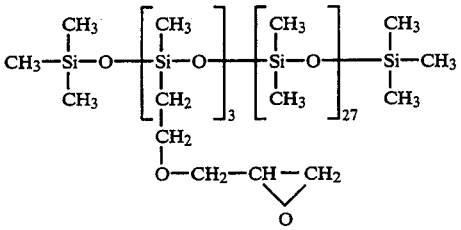
A-13
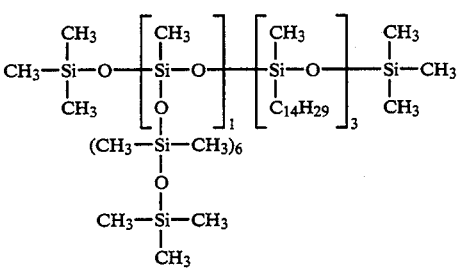
A-14
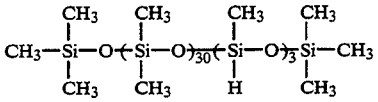
A-15
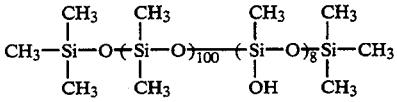
A-16
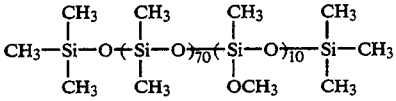
A-17
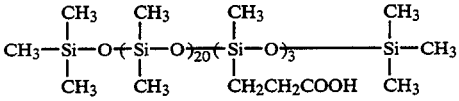
A-18
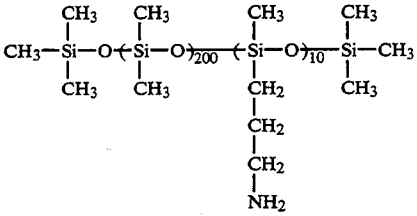
A-19
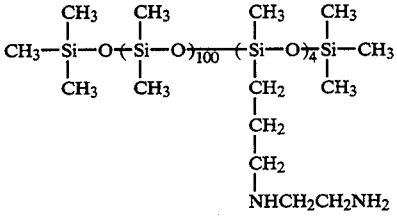
A-20
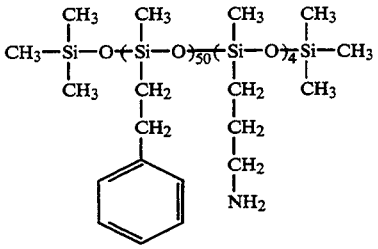
A-21
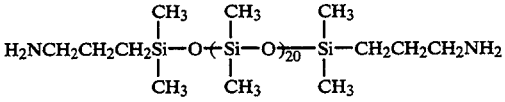

-continued
A-22
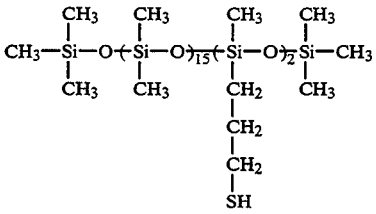
A-23
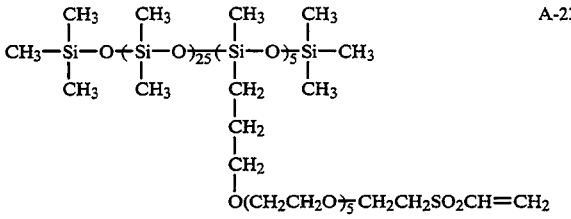
A-24
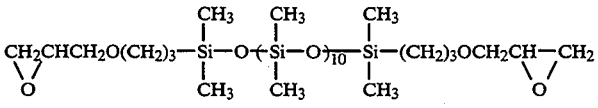
A-25
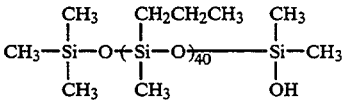
A-26
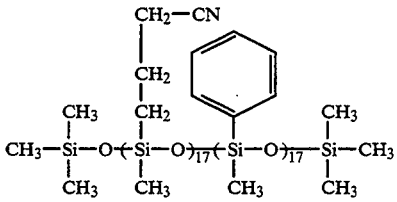
A-27
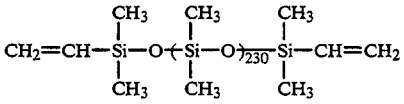
A-28
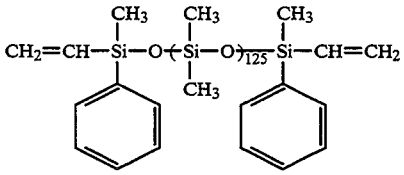
A-29
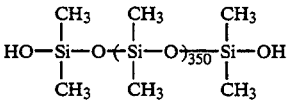
A-30
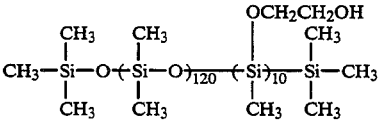
A-31
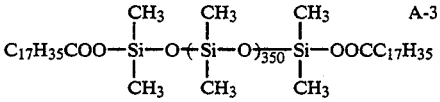
A-32
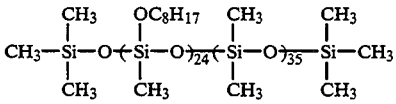
A-33
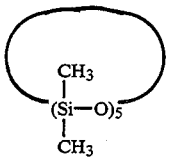
A-34
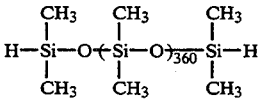
A-35
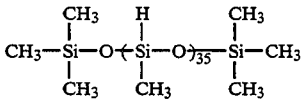
A-36
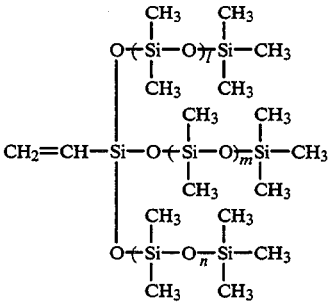
$l + m + n = 10 \sim 12$
A-37
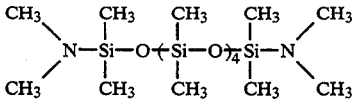

-continued
A-38
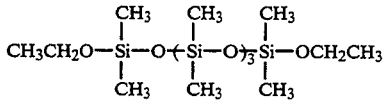
A-39
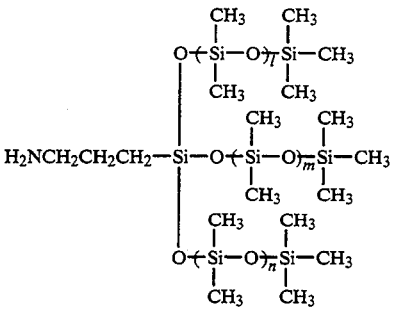
l + m + n = 10~12
A-40
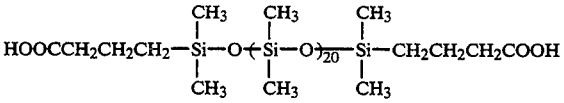
A-41
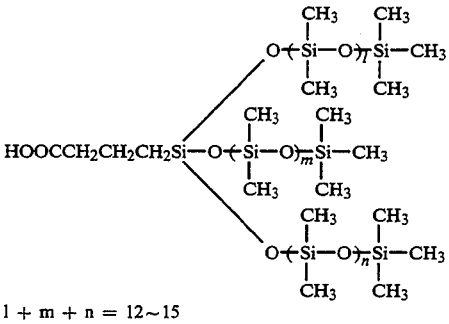
l + m + n = 12~15
A-42
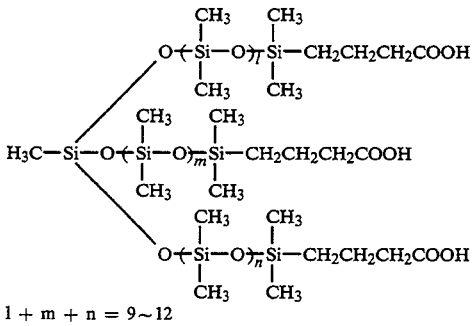
l + m + n = 9~12
A-43
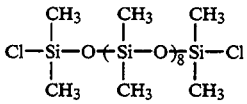
A-44
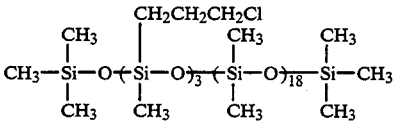
A-45
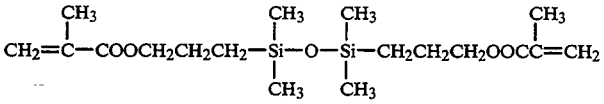
A-46
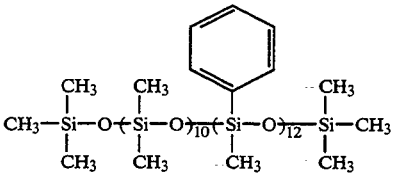
A-47
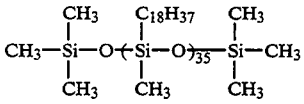
A-48
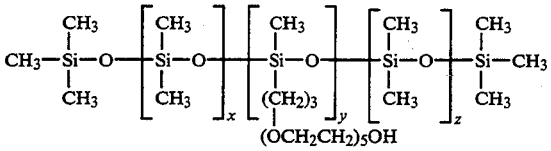
x + y + z = 30
A-49
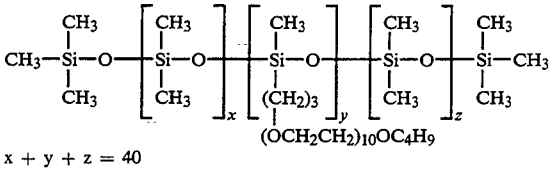
x + y + z = 40
A-50
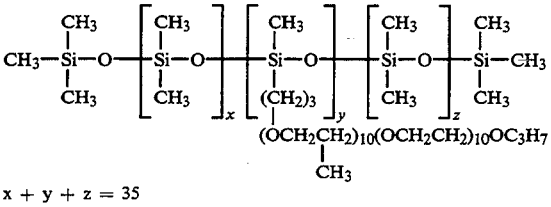
x + y + z = 35
A-51
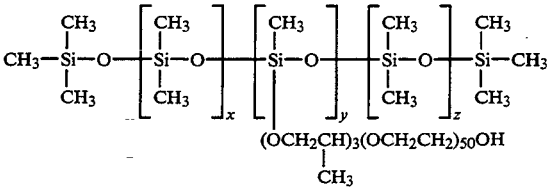
x + y + z = 50

-continued
A-52
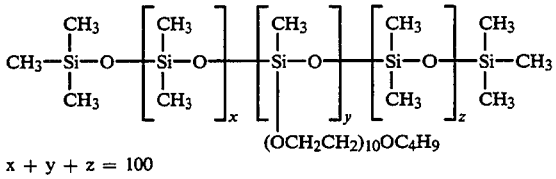
x + y + z = 100
A-53
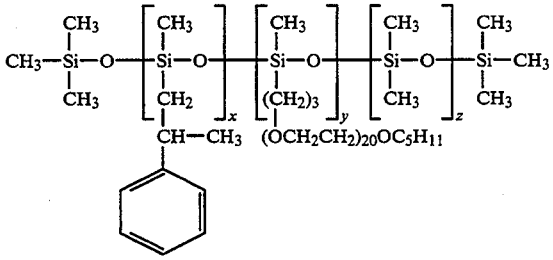
x + y + z = 40
A-54
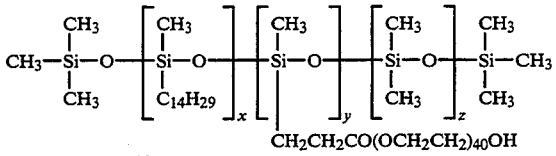
x + y + z = 200
A-55
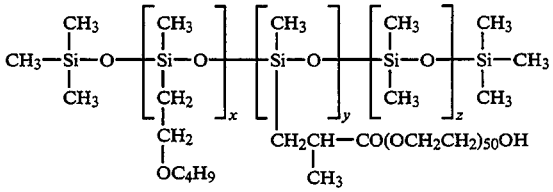
x + y + z = 35
A-56
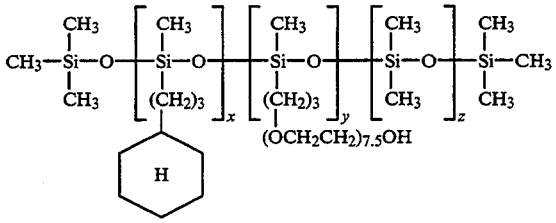
x + y + z = 10
A-57
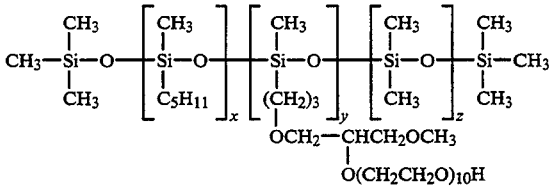
x + y + z = 40
A-58
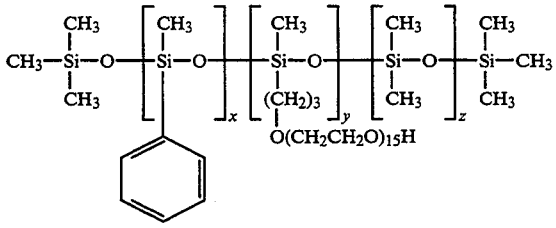
x + y + z = 60
A-59
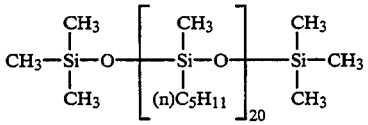
A-60
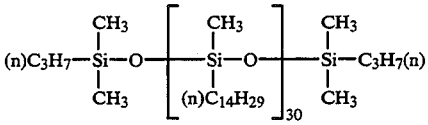
A-61
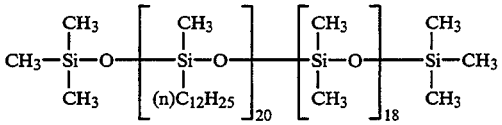
A-62
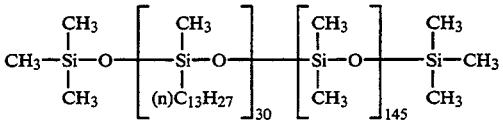
A-63
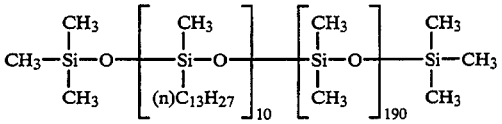

-continued
A-64
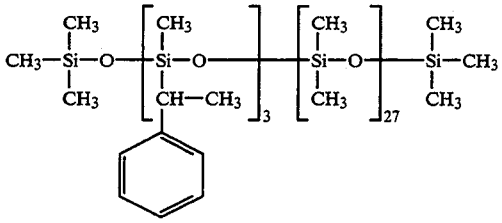
A-65
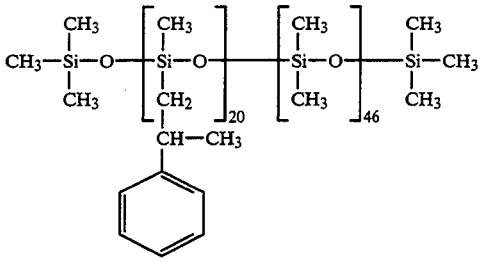
A-66
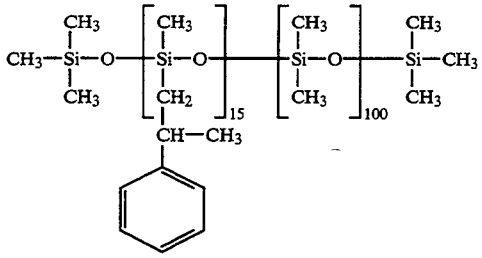
A-67
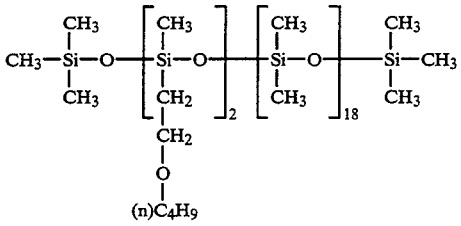
A-68
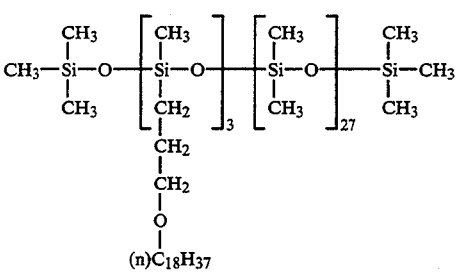
A-69
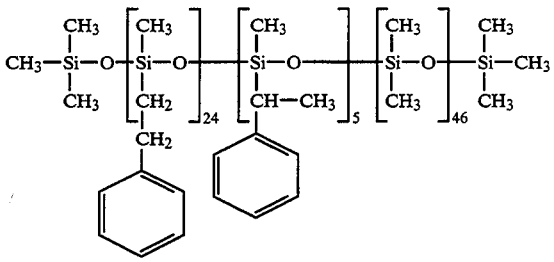
A-70
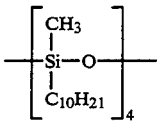
A-71
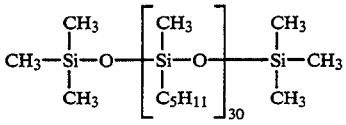
A-72
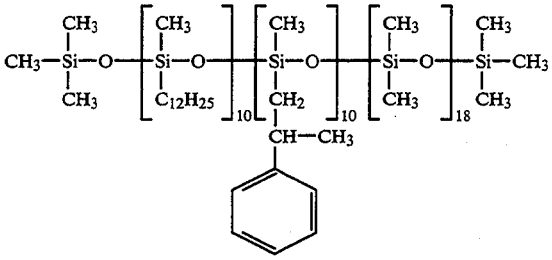
A-73
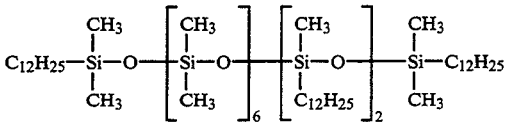
A-74
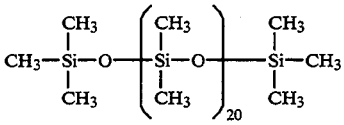
A-75
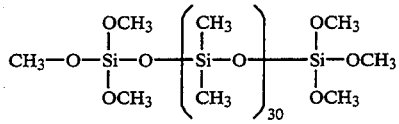
A-76
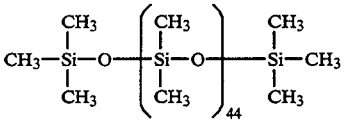
In the invention, it is preferred to contain organopolysiloxane in a non-light-sensitive outermost layer. When adding organopolysiloxane, it is preferred to contain it in a proportion within the range of 0.3 to 30% by weight of a water-soluble binder for forming the layer, such as gelatin.

The protective layers relating to the invention are allowed to contain the well-known materials for the protective layers of an ordinary silver halide photographic light sensitive material, besides the organopolysiloxane. The thickness of the protective layer containing organopolysiloxane is suitably within the range of 0.1 to 5.0 μm and, preferably, 0.3 to 1.5 μm.

As for the dispersants of organopolysiloxane, it is allowed to use any surfactants commonly applicable to photographic use. They include, for example, those selected suitably from the group consisting of an anionic surfactant, a nonionic surfactant, an amphoteric surfactant and a cationic surfactant. When making use of the above-mentioned surfactant and a supersonic or valve homogenizer, a dispersion can be performed. The preferable particle sizes of the dispersants is within the range of 0.05 to 10 μm. When the particle size thereof is too small, the slidability is deteriorated and, when it is too large, the subject light sensitive material is not preferable, because a devitrification is produced.

After the present inventors were trying studies further, they discovered, in the case where a protective layer containing organopolysiloxane is provided over to a silver halide emulsion layer, that a roller-staining production can remarkably be improved by containing a high-boiling organic solvent either in the protective layer or in a substantially non-light-sensitive interlayer interposed between the protective layer and the silver halide emulsion layer.

The thickness of the above-mentioned interlayer is within the range of, suitably, 0.1 to 5.0 μm and, preferably, 0.3 to 2.0 μm. The interlayer is also allowed to contain a UV absorbent and a formalin scavenger, besides the abovementioned high-boiling organic solvent.

The high-boiling organic solvents applicable thereto may be a liquid and an organic compound having a boiling point of not lower than 150° C.

Among the high-boiling organic solvents, the preferable include, for example, a phthalic acid ester, a phosphoric acid ester, an acid amide, a glycol derivative, an aliphatic dicarboxylic acid derivative and a phenol derivative, such as those given in JP OPI Publication No. 62-249145/1987, pp.10–11.

The high-boiling organic solvents may be contained in a proportion within the range of 1 to 150% by weight to 100% by weight of a hydrophilic colloidal binder such as gelatin, desirably within the range of 3 to 30% by weight and, preferably within the range of 3 to 30% by weight. The particles sizes thereof are preferably within the range of 0.005 to 0.5 μm.

In the invention, it is preferred that the outermost layer of the backing layers may contain a higher aliphatic acid represented by the foregoing formula (1) or (2) (or the salts thereof), or an aliphatic hydrocarbon group-containing ester having at least 8 carbon atoms, that is, an aliphatic ester having at least the total 24 carbon atom numbers of the aliphatic hydrocarbon group thereof.

Formula (1)

RCOOM wherein R represents an aliphatic hydrocarbon group in which the carbon atoms thereof are preferably 12 to 70 and the group may have a substituent; and M represents a cation including, for example, a hydrogen atom, a metal such as Na, K, Li, Mg, Ca, Sn and Ba, $HN(R_2)_3$ or $N(R_2)_4$ (in which $R_2$ represents an alkyl group having 1 to 18 carbon atoms or a substituted alkyl group). In the invention, the cations represented by M is preferably the other metals than a hydrogen atom.

$$R_1-\underset{\underset{O}{\|}}{C}-O-X-O-\underset{\underset{O}{\|}}{C}-R_2 \qquad \text{Formula (2)}$$

wherein X is a divalent group and $R_1$ and $R_2$ represent each, desirably, an aliphatic hydrocarbon group having 12 to 70 carbon atoms and they also have a total carbon atoms of $R_1$ and $R_2$ within the range of 24 to 140. More desirably, at least one of $R_1$ and $R_2$ is a branched aliphatic hydrocarbon group having 12 carbon atoms and they have a total carbon atoms of $R_1$ and $R_2$ within the range of 32 to 140.

The typically exemplified compounds desirably applicable to the invention will now be given below.

Exemplified compound B

| | |
|---|---|
| $(n)C_{21}H_{43}COOC_{18}H_{37}(iso)$ | B-1 |
| $(n)C_{21}H_{43}COOC_{18}H_{37}(iso)$ | B-2 |
| $(n)C_{21}H_{43}COOC_{18}H_{37}(iso)$ | B-3 |
| $(n)C_{21}H_{43}COOC_{24}H_{49}(iso)$ | B-4 |
| $(iso)C_{17}H_{35}COOC_{32}H_{65}\sim C_{36}H_{73}(iso)$ | B-5 |
| $(n)C_{27}H_{55}COOC_{18}H_{37}(iso)$ | B-6 |
| $(n)C_{17}H_{35}COOC_{32}H_{65}\sim C_{36}H_{73}(iso)$ | B-7 |
| $(n)C_{21}H_{43}COOC_{16}H_{33}(iso)$ | B-8 |
| $(n)C_{21}H_{43}COOC_{20}H_{41}(iso)$ | B-9 |
| $(n)C_{21}H_{43}COOC_{24}H_{49}(iso)$ | B-10 |
| $(iso)C_{17}H_{35}COOC_{50}H_{101}(n)$ | B-11 |
| $(iso)C_{23}H_{47}COOC_{24}H_{49}(iso)$ | B-12 |
| $(iso)C_{31}H_{63}\sim C_{36}H_{71}COOC_{18}H_{37}(iso)$ | B-13 |
| $(n)C_{27}H_{55}COOC_{24}H_{49}(iso)$ | B-14 |
| $COOC_{24}H_{49}(iso)$<br>\|<br>$(CH_2)_2$<br>\|<br>$COOC_{24}H_{49}(iso)$ | B-15 |
| $COOC_{24}H_{49}\sim C_{26}H_{53}(iso)$<br>\|<br>$(CH_2)_4$<br>\|<br>$COOC_{24}H_{49}\sim C_{26}H_{53}(iso)$ | B-16 |
| $COOC_{32}H_{65}\sim C_{36}H_{73}(iso)$<br>\|<br>$(CH_2)_4$<br>\|<br>$COOC_{32}H_{65}\sim C_{36}H_{73}(iso)$ | B-17 |
| $COOC_{32}H_{65}(iso)\sim C_{36}H_{73}(iso)$<br>\|<br>$(CH_2)_8$<br>\|<br>$COOC_{32}H_{65}\sim C_{36}H_{73}(iso)$ | B-18 |
| $COOC_{24}H_{49}\sim C_{26}H_{53}(iso)$<br>\|<br>$(CH_2)_{10}$<br>\|<br>$COOC_{24}H_{49}\sim C_{26}H_{53}(iso)$ | B-19 |

-continued
B-20
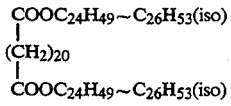
B-21
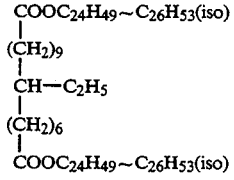
B-22
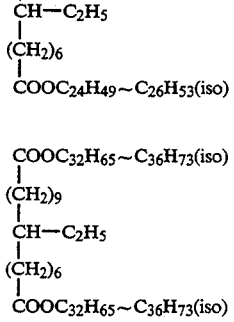
B-23
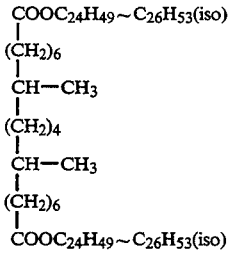
B-24
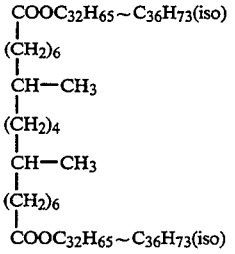
B-25
B-26
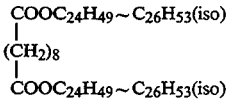
B-27
-continued
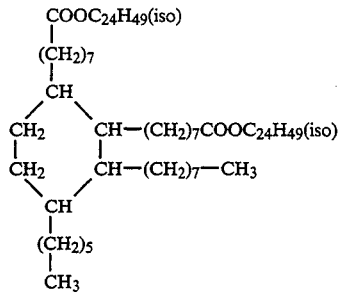
B-28
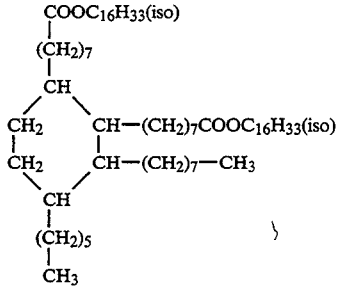
B-29
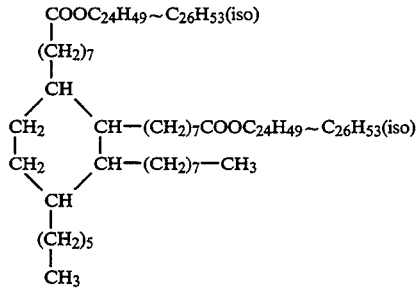
B-30
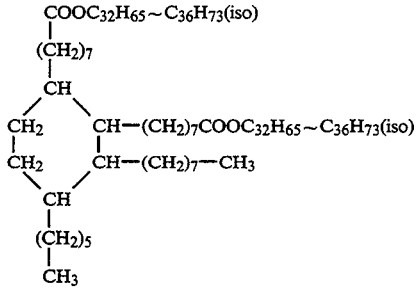
B-31
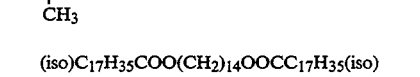
B-32
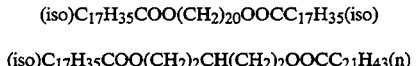
B-33
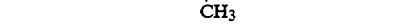
B-34
B-35
B-36
B-37
B-38

-continued

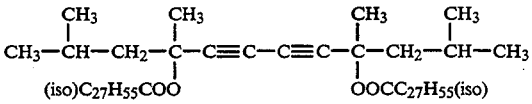

B-39

$(iso)C_{23}H_{47}COO(CH_2)_2OOCC_{23}H_{47}(iso)$ B-40

$(iso)C_{15}H_{31}COO(CH_2)_6OOCC_{21}H_{43}(n)$ B-41

$(iso)C_{31}H_{63}\sim C_{35}H_{71}COO(CH_2)_4OOCC_{31}H_{63}\sim C_{35}H_{71}(iso)$ B-42

$CH_2OOCC_{15}H_{31}(iso)$
$CHOOCC_{15}H_{31}(n)$
$CH_2OOCC_{15}H_{31}(n)$ B-43

$CH_2OOCC_{17}H_{35}(iso)$
$CHOOCC_{17}H_{35}(iso)$
$CH_2OOCC_{17}H_{35}(iso)$ B-44

$CH_2OOCC_{17}H_{35}(iso)$
$CHOOCC_{17}H_{35}(iso)$
$CH_2OOCC_{27}H_{55}(n)$ B-45

$CH_2OOCC_{17}H_{35}(iso)$
$CHOOCC_{17}H_{35}(iso)$
$CH_2OOCC_{21}H_{43}(n)$ B-46

$CH_3-CH_2-C(CH_2OOCC_{17}H_{35}(iso))(CH_2OOCC_{21}H_{43}(n))(CH_2OOCC_{21}H_{43}(n))$ B-47

$CH_3-CH_2-C(CH_2OOCC_{17}H_{35}(iso))(CH_2OOCC_{17}H_{35}(n))(CH_2OOCC_{27}H_{55}(n))$ B-48

$(n)C_{21}H_{43}COOCH_2-C(CH_2OOCC_{17}H_{35}(iso))(CH_2OOCC_{17}H_{35}(iso))(CH_2OOCC_{21}H_{43}(n))$ B-49

$(n)C_{21}H_{43}COOCH_2-C(CH_2OOCC_{17}H_{35}(iso))(CH_2OOCC_{21}H_{43}(iso))(CH_2OOCC_{21}H_{43}(n))$ B-50

$(iso)C_{17}H_{35}COOCH_2-(CH)_4-CH_2OOCC_{17}H_{35}(iso)$, $OOCC_{12}H_{25}(n)$ B-51

$(iso)C_{17}H_{35}COOCH_2-(CH)_4-CH_2OOCC_{17}H_{35}(iso)$, $OOCC_{17}H_{35}(iso)$ B-52

$(n)C_{21}H_{43}COOC_{18}H_{37}(iso)$ B-53

$(n)C_{21}H_{43}COOC_{24}H_{49}(iso)$ B-56

$(iso)C_{17}H_{35}COOC_{32}H_{65}\sim C_{36}H_{73}(iso)$ B-57

$(n)C_{27}H_{55}COOC_{18}H_{37}(iso)$ B-58

$(n)C_{17}H_{35}COOC_{32}H_{65}\sim C_{36}H_{73}(iso)$ B-59

$(n)C_{21}H_{43}COOC_{16}H_{33}(iso)$ B-60

$(n)C_{21}H_{43}COOC_{20}H_{41}(iso)$ B-61

$(n)C_{21}H_{43}COOC_{24}H_{49}(iso)$ B-62

$(iso)C_{17}H_{35}COOC_{50}H_{101}(n)$ B-63

-continued $(iso)C_{23}H_{47}COOC_{24}H_{49}(iso)$ B-64

$(iso)C_{31}H_{63}\sim C_{35}H_{71}COOC_{18}H_{37}(n)$ B-65

$(n)C_{27}H_{55}COOC_{24}H_{49}(iso)$ B-66

$(n)C_{15}H_{31}COOC_{16}H_{33}(n)$ B-67

$(n)C_{17}H_{35}COOC_{18}H_{34}(n)$ B-68

$(CH_2)_{10}(COOC_{32}H_{65}\sim C_{36}H_{73}(iso))(COOC_{32}H_{65}\sim C_{36}H_{73}(iso))$ B-69

$(CH_2)_{12}(COOC_{16}H_{33}(n))(COOC_{21}H_{43}(n))$ B-70

$(CH_2)_2(COOC_{18}H_{37}(n))(COOC_{18}H_{37}(n))$ B-71

$(CH_2)_4(COOC_{16}H_{33}(n))(COOC_{16}H_{33}(n))$ B-72

$(CH_2)_8(COOC_{12}H_{25}(n))(COOC_{12}H_{25}(n))$ B-73

$O(CH_2)_2(CH_2)_2(COOC_{21}H_{43}(n))(COOC_{21}H_{43}(n))$ B-74

$(n)C_{17}H_{35}COONa$ B-75

$(n)C_{21}H_{43}COOH$ B-76

$(n)C_{21}H_{43}COONa$ B-77

$(n)C_{21}H_{43}COOHN(C_2H_5)_3$ B-78

$(n)C_{21}H_{43}COON(C_2H_5)_4$ B-79

$(n)C_{27}H_{55}COOK$ B-80

$(iso)C_{23}H_{47}COOH$ B-81

$(n)C_{15}H_{31}COOHN(C_8H_{17})_3$ B-82

$(n)C_{17}H_{35}COOH$ B-83

$(iso)C_{17}H_{35}COO\frac{1}{2}Ca$ B-84

$C_{21}H_{41}COOK$ B-85

$C_{21}H_{43}COOHN(C_2H_4OH)_3$ B-86

$C_{17}H_{35}COO\frac{1}{2}Ba$ B-87

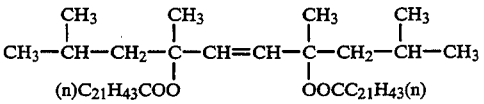

B-88

-continued

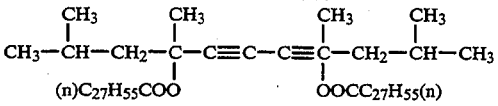

B-89

$(n)C_{17}H_{35}COO(CH_2)_2OOCC_{17}H_{35}(n)$ B-90

$(n)C_{21}H_{43}COO(CH_2CH_2O)_2OCC_{21}H_{43}(n)$ B-91

$(n)C_{15}H_{31}COO(CH_2)_4OOCC_{15}H_{31}(n)$ B-92

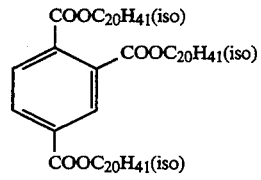

B-93

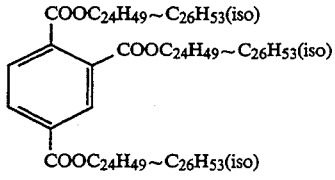

B-94

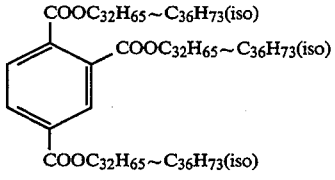

B-95

B-96

B-97

The above-given compounds can be used upon dissolving in solvents including, for example, alcohols such as methanol and ethanol; ketones such as acetone and methylethyl ketone; halogenohydrocarbons such as methylene chloride and carbon tetrachloride; ethers such as diethyl ether and dioxane; and aromatic hydrocarbons such as benzene and toluene.

The above-given compounds may be used independently or in combination. The binders jointly applicable thereto include, for example, a polymer or copolymer of polystyrene, polymethyl methacrylate, polyvinylidene chloride, polyacrylonitrile or polyvinyl acetate; a cellulose derivative of cellulose diacetate, cellulose triacetate, cellulose nitrate, ethyl cellulose or cellulose propionate; and an acetal such as polyvinyl formal, polyvinyl acetal and polyvinyl benzal. There is no limitation thereto, provided, they shall have a layer-forming function and can also be solved in a solvent.

The compounds represented by Formula (1) or (2) are used in an amount within the range of, desirably, 1 to 500 mg and, preferably, 5 to 100 mg per sq.meter of a light sensitive material used.

The hydrophilic colloids applicable to the invention include, besides gelatin, for example, a derivative gelatin, colloidal albumin, agar, gum arabic, alginic acid, cellulose derivatives such as a cellulose acetate so hydrolyzed as to contain acetyl in a proportion up to 19 to 26%, acrylamide, imidopolyacryl amide, casein, a vinyl alcohol polymer containing a urethane carboxylic acid group or a cyanoacetyl group, such as vinyl alcohol and a vinyl cyanoacetate copolymer, polyvinyl alcohol, polyvinyl pyrrolidone, hydrolyzed polyvinyl acetate, and a polymer prepared by polymerizing a protein or an acylation-saturated protein with a monomer having a vinyl group.

In the invention, it is desirable if required to use a variety of physical layer property improvers such as a layer hardener, for the purpose of improving the physical property of a coated layer comprising the abovementioned hydrophilic colloids. When making combination use of a layer hardener, for example, not only the synergistic effects can be enjoyed on the scratch-prevention so-called in the invention, but also the mechanical strength of coated layers and the antisolving characteristics against processing solutions can also be improved, so that a light sensitive material having an excellent physical layer property can be prepared.

When making use of gelatin as the above-mentioned hydrophilic colloid, the typical examples of the layer hardeners include, concretely, those of the aldehyde type, epoxy type, ethylene imine type, active halogen type, vinyl sulfone type, isocyanate type, sulfonic acid ester type, carbodiimide type, mucochloric acid type and acyloyl type.

The gelatin layer hardeners applicable to the invention are given in, for example, U.S. Pat. Nos. 3,539,644, 3,642,486, 2,726,162, 2,816,125 and 3,047,394; West German Patent No. 1,085,663; British Patent No. 1,033,518; JP-EP No. 48-3549/1973; PB Report No. 19921; U.S. Pat. Nos. 2,950,197, 2,964,404, 2,983,611, 3,271,175, 2,938,892, 3,640.720, 3,058,827 and 1,994,611; British Patent Nos. 822,061, 1,042,083, 1,202,052 and 1,230,354; West German Patent No. 872,153; JP-EP Nos. 44-29622/1969, 47-25373/1972, 47-8736/1972 and 46-38715/1972; JP OPI Publication Nos. 49-73122/1974, 48-74832/1973, 49-24435/1974, 48-43319/1973, 48-43320/1973 and 49-116154/1974; and JP Application Nos. 48-112325/1973, 48-110996/1973 and 49-15096/1974.

The layer hardeners may be used in any amount, provided that the kinds of the objective gelatin layers, the physical properties required and the photographic characteristics can be satisfied without spoiling any of the effects of the invention. However, the layer hardeners are contained in a proportion of not less than 0.01% by weight and desirably not less than 1% by weight of the amount of the gelatin in dried state contained in the outermost layer or other hydrophilic colloidal layers of a light sensitive material of the invention.

The hydrophilic colloidal layers of a light sensitive material of the invention are also allowed to contain, if required, the other photographic additives than the abovementioned layer hardeners. For example, it is allowed to use a gelatin plasticizer, a surfactant, a UV absorbent, an antistaining agent, a Ph controller, an antioxidant, an antistatic agent, a thickener, a granularity improver, a dye, a mordant, a whitening agent, a developing rate controller and a matting agent, provided, the effects of the invention cannot be spoiled.

Among the various additives given above, those preferably applicable to the invention include, for example, as follows.

The thickeners or plasticizers disclosed in U.S. Pat. No. 2,960,404; JP-EP No. 43-4939/1968; West German Patent No. 1,904,604; JP OPI Publication No. 48-63715/1973; JP-EP No. 45-15462/1970; Belgian Patent No. 762,833; U.S. Pat. No. 3,767,410; and Belgian Patent No. 588,143 and, in particular, a styrene-sodium maleate copolymer and dextran sulfate;

The UV absorbents disclosed in JP-EP Nos. 48-5496/1973, 48-41572/1973, 48-30492/1973 and 48-31255/1973; U.S. Pat. No. 3,253,921; and British Patent No. 1,309,349 and, in particular, 2-(2'-hydroxy-5'-tert-butylphenyl)benzotriazole, 2-(2'-hydroxy-3',5'-di-tert-butylphenyl)benzotriazole, 2-(2'-hydroxy-3'-tert-butyl-5'-butylphenyl)-5-chlorobenzotriazole, and 2-(2'-hydroxy-3',5'-di-tert-butylphenyl)-5-chlorobenzenetriazole;

The surfactants disclosed in British Patent Nos. 548,532 and 1,216,389; U.S. Pat. Nos. 3,026,202 and 3,514,293; JP-EP Nos. 44-26580/1969, 43-17922/1968, 43-17926/1968, 43-13166/1968 and 48-20785/1973; French Patent No. 202,585; and Belgian Patent No. 773,459 and, in particular, sodium-di-2-ethylhexyl sulfosuccinate, sodium-amyl-decyl sulfosuccinate, sodium dodecylbenzene sulfonate and sodium triisopropyl naphthalene sulfonate;

The antistaining agents disclosed in U.S. Pat. Nos. 2,360,210, 2,728,659, 2,732,300 and 3,700,453 and, in particular, 2-methyl-5-hexadecyl-hydroquinone, 2-methyl-5-secoctadecyl-hydroquinone and 2,5-di-tert-octyl hydroquinone;

The antistatic agents disclosed in JP-EP No. 46-24159/1971; JP OPI Publication No. 48-89979/1973; U.S. Pat. Nos. 2,882,157 and 2,971,535; JP OPI Publication Nos. 48-20785/1973, 48-43130/1973 and 48-90391/1973; JP-EP Nos. 46-39312/1971, 48-43809/1973, 49-4853/1974, 49-64/1974 and 47-8742/1972; and JP OPI Publication No. 47-33627/1972; and The matting agents disclosed in U.S. Pat. Nos. 1,221,980, 2,992,101 and 2,956,884 and, in particular, silica gel having a particle size within the range of 0.5 to 20 μm and a polymethyl methacrylate polymer having a particle size within the range of 0.5 to 20 μm.

A layer containing an antistatic agent may be provided to the support side of the outermost backing layer. The antistatic agents for this purpose include, for example, the ionen type polymers given in JP-EP No. 57-56059/1982, the cross-linked polymers having a quaternary ammonium vinylbenzylate on the polymer position, the electrolyte-containing alumina sol given in JP-EP No. 57-12979/1982 and the fine particles of the crystalline metal oxides given in JP OPI Publication No. 56-143431/1981.

When making use of the above-mentioned ionen type polymer, there may be some instances where a scum may be produced in a light sensitive material, because the resistance of this type polymers are relatively deteriorated against the compositions of an aqueous developing solution. When a layer containing a compound represented by Formula (1) or (2) is provided to the outermost backing layer, the above-mentioned defect can be improved, because the outermost layer displays an effect that any permeation of the ionen type polymers into a developing solution can be prevented.

When making use of the above-mentioned alumina sol having an electrolytes or the fine particles of crystalline metal oxide as an antistatic agent, the coatability of the outermost backing layer can be excellent and the adhesion property between the outermost layer and an antistatic agent-containing layer can also be improved, so that a light sensitive material can be so prepared as to have an excellent slidability and an improved dried-unevenness.

When a compound represented by the foregoing Formula (1) or (2) is contained in the outermost backing layer, the outermost layer on the back surface or a layer containing an antistatic agent is allowed to contain, if required, a matting agent, a surfactant and a dye.

As for the matting agents, the fine particles of silicon dioxide having an average particle size within the range of 0.01 to 10μ may preferably be used. There is no special imitation to the above-mentioned various additives, the various additives for light sensitive silver halide emulsion layers and the preparation procedures thereof. For the details thereof, the descriptions in Research Disclosure, Vol. 176, pp.22–31, Dec., 1978, for example, may be referred.

The other layers than the above-mentioned layers, such as a binder layer, may also be arranged between the outermost backing layer and an antistatic agent-containing layer.

The methods for coating the layer containing a compound represented by Formula (1) or (2) include the well-known methods such as a curtain-coating method, a reverse-roll coating method, a fountain air doctor coating method, a slide-hopper coating method, an extrusion coating method and a dip-coating method.

The photographic component layers relating to the invention are also allowed to contain a latex-like water-dispersible vinyl compound. As for the latexes, it is allowed to use a homo- or co-polymer such as those of alkyl acrylate, alkyl methacrylate, acrylic acid, methacrylic acid, glycidyl acrylate, styrene, vinyl chloride and vinylidene chloride.

The silver halide emulsions applicable to the invention can be chemically sensitized in any ordinary methods. The chemical sensitization thereof can be performed with noble metal salts including, for example, a gold compound, platinum, palladium, rhodium and iridium, such as those given in U.S. Pat. Nos. 2,399,083 and 2,597,856; the sulfur compounds given in U.S. Pat. Nos. 2,410,689 and 3,501,313 and, besides, a stannous salt and an amine.

The silver halide emulsions applicable to the invention may contain a stabilizer or an antifoggant including, for example, 4-hydroxy-6-methyl-1,3,3a,7-tetrazaindene, 3-methylbenzothiazole, 1-phenyl-5-mercaptotetrazole and, besides, many kinds of heterocyclic compounds, mercury-containing compounds, mercapto compounds and metal salts.

In the silver halide emulsions applicable to the invention, it is also allowed to use therein a variety of spectrally sensitizing dyes such as a melocyanine dye, a carbocyanine dye and a cyanine dye so as to meet the purposes of the emulsions.

In the invention, is is further allowed to use a color coupler such as a 4-equivalent type methylene yellow coupler, a 2-equivalent type diketomethylene yellow coupler, a 4- or 2-equivalent type pyrazolone or indazolone magenta coupler and an α-naphthol type or phenol type cyan coupler. It is further allowed to use therein the so-called DIR couplers.

In addition to the above, the photographic component layers of the light sensitive materials of the invention are allowed to contain a dye, a UV absorbent, such a layer hardener as mentioned above, a surfactant and a polymer latex.

The supports applicable to the light sensitive materials of the invention include, for example, a sheet of film or baryta paper made of a polyolefin (such as polystyrene), a cellulose derivative (such as polystyrene and cellulose triacetate), a polyester (such as polyethylene terephthalate), a support comprising a sheet coated with the above-given polymer film on the both sides of a synthetic paper or paper and the analogous materials thereof.

The photographic component layers of the light sensitive materials of the invention may be coated independently one after another or altogether simultaneously in various methods such as a dip coating method, an air-knife coating method, a curtain coating method and an extrusion coating method.

For the details of various additives, vehicles, supports and coating methods, the descriptions in 'Product Licensing Index' Vol.92, pp.107–110, Dec., 1971 can be referred.

There is no special limitation to the exposure light sources for the light sensitive materials of the invention. It is allowed to use any low to high luminance light sources, and the exposures can be made for a period of time within the range of the order of some ten seconds to $10^{-6}$ seconds.

The light sensitive materials of the invention can be applied to any one of a black-and-white and color photographic light sensitive materials and those for general use, printing use, X-ray use and radiographic use. To be more concrete, the light sensitive materials of the invention can be applied to any one of the silver halide photographic light sensitive materials such as a film, paper or reversal black-and-white negative silver halide photographic light sensitive materials, a film, paper or reversal color negative silver halide photographic light sensitive materials and the so-called color-in-developer type color photographic light sensitive materials for which a processing solution contains a color coupler.

EXAMPLES

The concrete examples of the invention will now be detailed below.

In the following examples, the amounts added in every silver halide photographic light sensitive material will be indicated by grams per sq.meter of the light sensitive material unless otherwise expressly stated. The amounts of every silver halide and colloidal silver will be indicated in terms of the silver contents thereof.

Example 1

An undercoating was applied to one side of a triacetyl cellulose film support having a thickness shown in Table-1 and the backing layers having the following compositions were provided in order from the support to the side (of the backing layer) opposite to the side to which the above-mentioned undercoat was applied.

Backing layer 1

The following coating solution for the backing layer 1 was coated in a proportion of 20 ml/m$^2$ and the coated layer was dried up at 80° C. for 5 minutes.

Coating solution for the backing layer 1

| | |
|---|---|
| Alumina sol AS-100 (produced by Nissan Chemical Industrial Co.) | 40 g |
| Acetone | 500 ml |
| Methanol | 400 ml |
| Dimethyl formamide | 100 ml |

Backing layer 2

The following coating solution for the backing layer 2 was coated on the above-mentioned backing layer 1 so as to be 20 ml/m$^2$ and it was dried up at 80° C. for 5 minutes.

Coating solution for backing layer 2

| | |
|---|---|
| Diacetyl cellulose | 1 g |
| Finely particulate $SiO_2$ (having an average particle size of 3.0 μm) | 0.020 g |
| Acetone | 500 ml |
| Ethyl acetate | 500 ml |

Backing layer 3

The following coating solution for backing layer 3 was coated on a film on which the above-mentioned backing layer 2 was coated so as to be 20 ml/m$^2$ and it was dried up at 90° C. for 5 minutes.

Coating solution for backing layer 3

| | |
|---|---|
| Toluene | 700 ml |
| Methylethyl ketone | 300 ml |
| Compound contained in the backing layer (See Table-1) | 1 g |

Next, multilayered color photographic light sensitive material samples 1 through 35 were each prepared in the following manner; each of the layers having the following compositions was formed in order on the front side of a support provided thereto with backing layers.

| | |
|---|---|
| Layer 1; An antihalation layer (HC) | |
| Black colloidal silver | 0.15 g |
| UV absorbent (UV-l) | 0.20 g |
| Compound (CC-1) | 0.02 g |
| High boiling solvent (Oil-1) | 0.20 g |
| High boiling solvent (Oil-2) | 0.20 g |
| Gelatin | 1.6 g |
| Layer 2; An interlayer (IL-1) | |
| Gelatin | 1.3 g |
| Layer 3; | |
| A low red-sensitive emulsion layer (R-L) | |
| A silver iodobromide emulsion (having an average grain size of 0.3 μm and an average iodine content of 2.0 mol %) | 0.4 g |
| A silver iodobromide emulsion (having an average grain size of 0.4 μm and an average iodine content of 8.0 mol %) | 0.3 g |
| Sensitizing dye (S-1) | $3.2 \times 10^{-4}$ mols per mol of silver |
| Sensitizing dye (S-2) | $3.2 \times 10^{-4}$ mols per mol of silver |
| Sensitizing dye (S-3) | $0.2 \times 10^{-4}$ mols per mol of silver |
| Cyan coupler (C-1) | 0.50 g |
| Cyan coupler (C-2) | 0.13 g |
| Colored cyan coupler (CC-1) | 0.07 g |
| DIR compound (D-1) | 0.006 g |
| DIR compound (D-2) | 0.01 g |
| A high boiling solvent (Oil-1) | 0.55 g |
| Gelatin | 1.0 g |
| Layer 4; | |
| A high red-sensitive emulsion layer (R-H) | |
| A silver iodobromide emulsion (having | 0.9 g |

-continued

| | |
|---|---|
| an average grain size of 0.7 μm and an average iodine content of 7.5 mol %) | |
| Sensitizing dye (S-1) | $1.7 \times 10^{-4}$ mols per mol of silver |
| Sensitizing dye (S-2) | $1.6 \times 10^{-4}$ mols per mol of silver |
| Sensitizing dye (S-3) | $0.1 \times 10^{-4}$ mols per mol of silver |
| Cyan coupler (C-2) | 0.23 g |
| Colored cyan coupler (CC-1) | 0.03 g |
| DIR compound (D-2) | 0.02 g |
| A high boiling solvent (Oil-1) | 0.25 g |
| Gelatin | 1.0 g |
| Layer 5; An interlayer (IL-2) | |
| Gelatin | 0.8 g |
| Layer 6; | |
| A low green sensitive emulsion layer (G-L) | |
| A silver iodobromide emulsion (having an average grain size of 0.4 μm and an average iodine content of 8.0 mol %) | 0.6 g |
| A silver iodobromide emulsion (having an average grain size of 0.3 μm and an average iodine content of 2.0 mol %) | 0.2 g |
| Sensitizing dye (S-4) | $6.7 \times 10^{-4}$ mols per mol of silver |
| Sensitizing dye (S-5) | $0.8 \times 10^{-4}$ mols per mol of silver |
| Magenta coupler (M-1) | 0.17 g |
| Magenta coupler (M-2) | 0.43 g |
| Colored magenta coupler (CM-1) | 0.10 g |
| DIR compound (D-3) | 0.02 g |
| A high boiling solvent (Oil-2) | 0.7 g |
| Gelatin | 1.0 g |
| Layer 7; | |
| A high green sensitive emulsion layer (G-H) | |
| A silver iodobromide emulsion (having an average grain size of 0.7 μm and an average iodine content of 7.5 mol %) | 0.9 g |
| Sensitizing dye (S-6) | $1.1 \times 10^{-4}$ mols per mol of silver |
| Sensitizing dye (S-7) | $2.0 \times 10^{-4}$ mols per mol of silver |
| Sensitizing dye (S-8) | $0.3 \times 10^{-4}$ mols per mol of silver |
| Magenta coupler (M-1) | 0.30 g |
| Magenta coupler (M-2) | 0.13 g |
| Colored magenta coupler (CM-1) | 0.04 g |
| DIR compound (D-3) | 0.004 g |
| A high boiling solvent (Oil-2) | 0.35 g |
| Gelatin | 1.0 g |
| Layer 8; A yellow filter layer (YC) | |
| Yellow colloidal silver | 0.1 g |
| Additive (HS-1) | 0.07 g |
| Additive (HS-2) | 0.07 g |
| Additive (SC-1) | 0.12 g |
| A high boiling solvent (Oil-2) | 0.15 g |
| Gelatin | 1.0 g |
| Layer 9; | |
| A low blue sensitive emulsion layer (B-L) | |
| A silver iodobromide emulsion (having an average grain size of 0.3 μm and an average iodine content of 2.0 mol %) | 0.25 g |
| A silver iodcibromide emulsion (having an average grain size of 0.4 μm and an average iodine content of 8.0 mol %) | 0.25 g |
| Sensitizing dye (S-9) | $5.8 \times 10^{-4}$ mols per mol of silver |
| Yellow coupler (Y-1) | 0.6 g |
| Yellow coupler (Y-2) | 0.32 g |
| DIR compound (D-1) | 0.003 g |
| DIR compound (D-2) | 0.006 g |
| A high boiling solvent (Oil-2) | 0.18 g |
| Gelatin | 1.3 g |
| Layer 10; | |
| A high blue sensitive emulsion layer (B-H) | |
| A silver iodobromide emulsion (having an average grain size of 0.8 μm and an average iodine content of 8.5 mol %) | 0.5 g |
| Sensitizing dye (S-10) | $3 \times 10^{-4}$ mols per mol of silver |
| Sensitizing dye (S-11) | $1.2 \times 10^{-4}$ mols per mol of silver |
| Yellow coupler (Y-1) | 0.18 g |
| Yellow coupler (Y-2) | 0.10 g |
| A high boiling solvent (Oil-2) | 0.05 g |
| Gelatin | 1.0 g |
| Layer 11; A protective layer 1 (PRO-1) | |
| A silver iodobromide emulsion (having an average grain size of 0.08 μm and an average iodine content of mol %) | 0.3 g |
| UV absorbent (UV-1) | 0.07 g |
| UV absorbent (UV-2) | 0.10 g |
| Additive (HS-1) | 0.2 g |
| Additive (HS-2) | 0.1 g |
| A high boiling solvent (Oil-1) | 0.07 g |
| A high boiling solvent (Oil-3) | 0.07 g |
| Gelatin | 0.8 g |
| Layer 12; A protective layer 2 (PRO-2) | |
| A compound contained in the protective layer | 0.04 g |
| Compound F | 0.004 g |
| Polymethyl methacrylate (having an average particle size of 3 μm) | 0.02 g |
| A methyl methacrylate:ethyl methacrylate: methacrylic acid copolymer having a proportion of 3:3:4 (by weight) and having an average particle size of 3 μm | 0.13 g |
| Gelatin | 0.5 g |

The silver iodobromide emulsion used in Layer 10 was prepared in the following procedures.

A silver iodobromide emulsion was prepared in a double-jet method, by making use of a monodisperse type silver iodobromide grains having an average grain size of 0.33 μm (and having a silver iodide content of 2 mol%) as the seed crystals.

With keeping solution <G-1> at a temperature of 70° C., pAg of 7.8 and pH of 7.0 and well stirring it, a seed emulsion was added thereto in an amount equivalent to 0.34 mols.

(Formation of internally high iodine phase, -core phase-)

Then, with keeping the flow rate of <H-1> to <S-1> to be 1:1, the solutions were added by taking 86 minutes at an accelerated flow rate (the final flow rate was 3.6 times as much as the initial flow rate.)

(Formation of externally low iodine phase, -shell phase-)

Successively, with keeping the pAg and pH to be 10.1 and 6.0 and the flow rate of <H-2> to <S-2> to be 1:1, the solutions were added by taking 65 minutes at an accelerated flow rate (the final flow rate was 5.2 times as much as the initial flow rate.)

The pAg and pH in the course of forming grains were controlled with an aqueous potassium bromide solution and an aqueous 56% acetic acid solution. After the grain formation was completed, the grains were washed with water in an ordinary flocculation method. The grains were redispersed by adding gelatin. The pAg and pH thereof were then adjusted to be 5.8 and 8.06 at 40° C.

The resulting emulsion was proved to be a monodisperse type emulsion containing octahedral silver iodobromide grains having an average grain size of 0.80 μm, a distribution range of 12.4% and a silver iodide content of 8.5 mol%.

| Solution <G-1> | |
|---|---|
| Ossein gelatin | 100.0 g |
| A 10 wt % methanol solution of Compound-[1] | 25.0 ml |
| An aqueous 28% ammonia solution | 440.0 ml |

-continued

| | |
|---|---|
| an aqueous 56% acetic acid solution | 660.0 ml |
| Add water to make | 5000.0 ml |
| Solution <H-1> | |
| Ossein gelatin | 82.4 g |
| Potassium bromide | 151.6 g |
| Potassium iodide | 90.6 g |
| Add water to make | 1030.5 ml |
| Solution <S-1> | |
| Silver nitrate | 309.2 g |
| An aqueous 28% ammonia solution | equivalent |
| Add water to make | 1030.5 ml |
| Solution <H-2> | |
| Ossein gelatin | 302.1 g |
| Potassium bromide | 770.0 g |
| Potassium iodide | 33.2 g |
| Add water to make | 3776.8 ml |
| Solution <S-2> | |
| Silver nitrate | 1133.0 g |
| An aqueous 28% ammonia solution | equivalent |

-continued

| | |
|---|---|
| Add water to make | 3776.8 ml |

Each of the above-mentioned emulsion was prepared in the same procedures, except that the average grain size of the seed crystals, temperature, pAg, pH, flow rate, adding time and halide composition were each varied and the average grain size and silver iodide content were made different.

The resulting emulsions were each proved to be the core/shell type monodisperse type emulsions having a distribution range of not wider than 20%. Each emulsion was subjected to an optimum chemical ripening treatment in the presence of sodium thiosulfate, chloroauric acid and ammonium thiocyanate and a sensitizing dye, 4-hydroxy-6-methyl- 1,3,3a,7-tetrazaindene and 1-phenyl-5-mercaptotetrazole were then added.

C-1

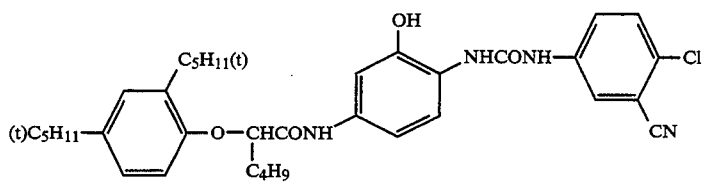

C-2

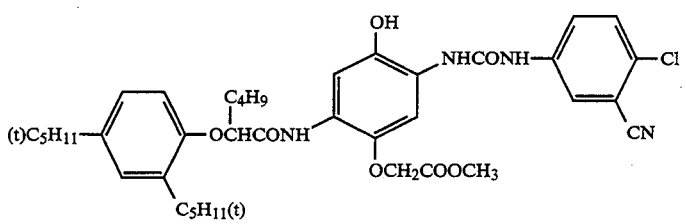

M-1

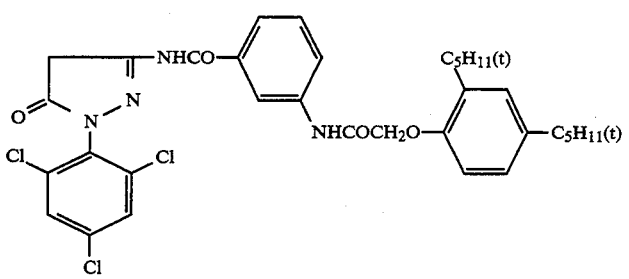

M-2

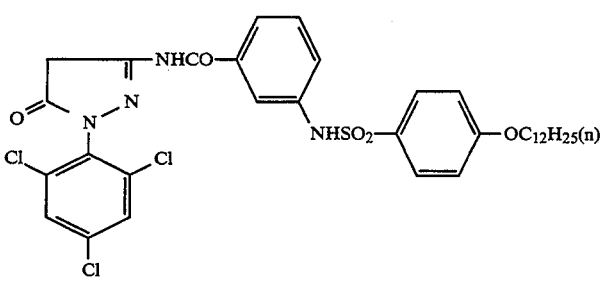

-continued
Y-1
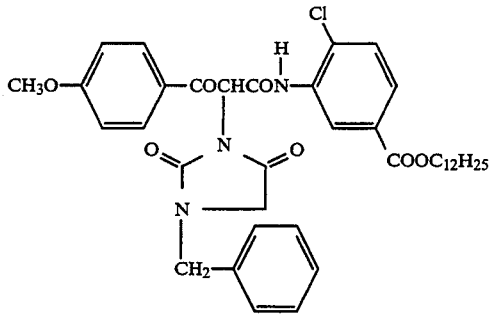
Y-2
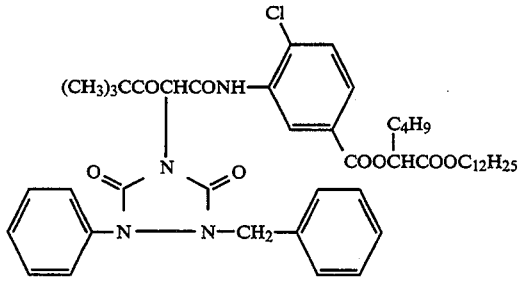
CC-1
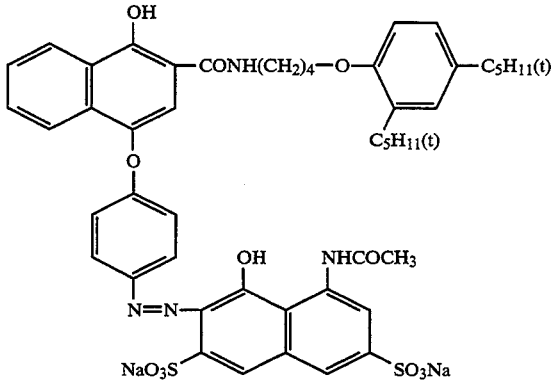
CM-1
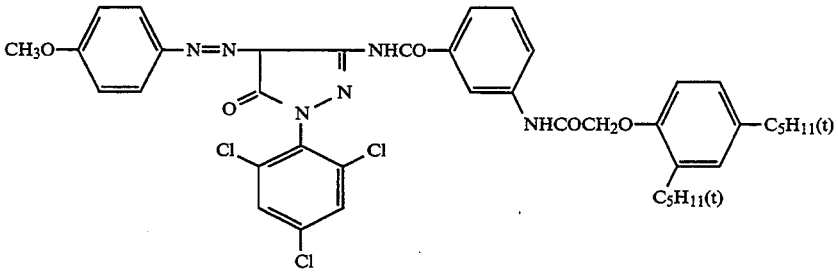
D-1
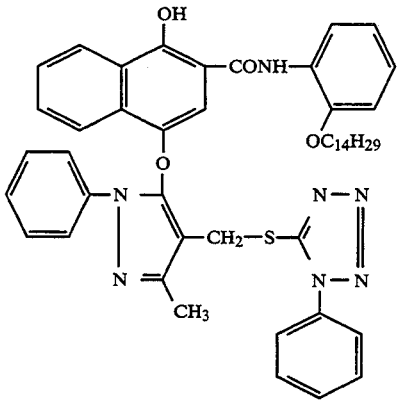

-continued
D-2
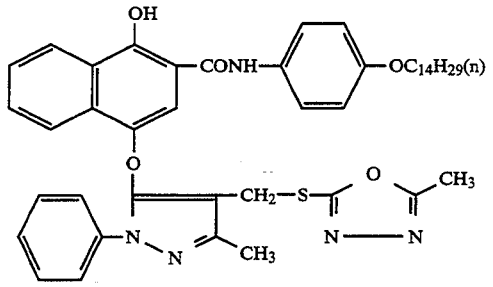
D-3
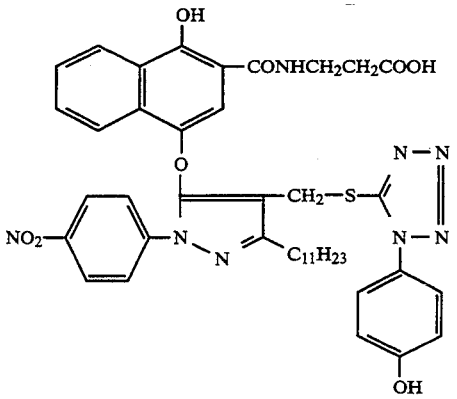
UV-1
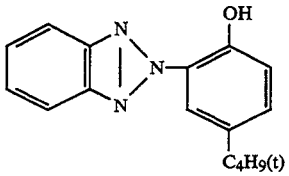
UV-2
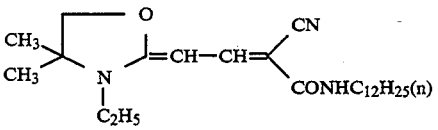
S-1
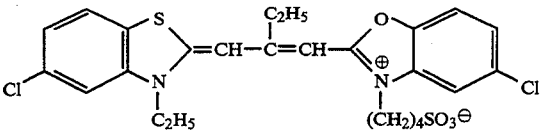
S-2
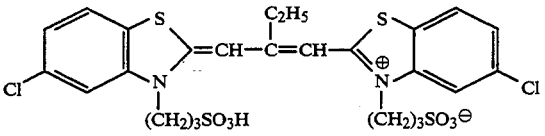
S-3
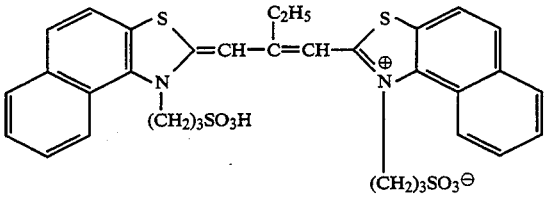
S-4
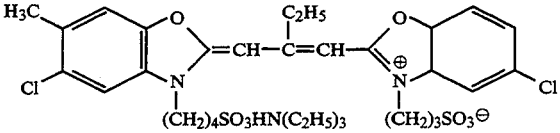

-continued
S-5
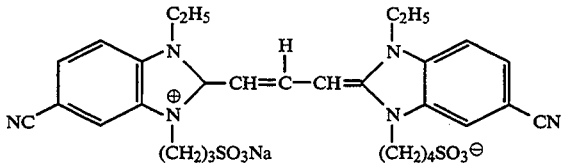
S-6
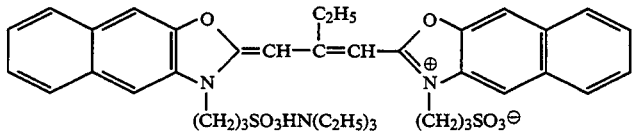
S-7
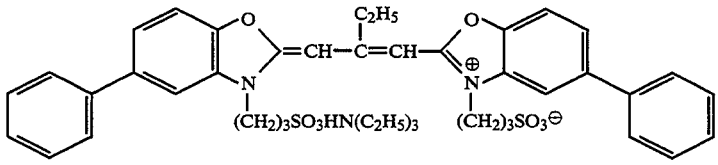
S-8
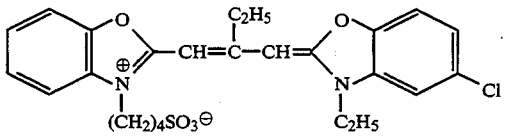
S-9
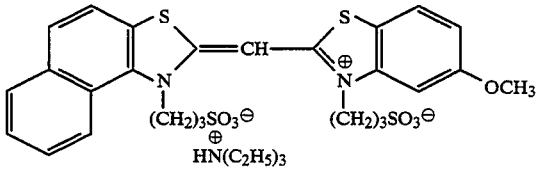
S-10
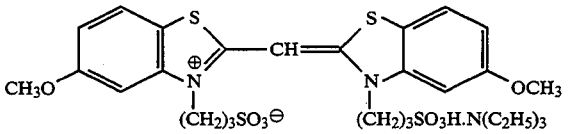
S-11
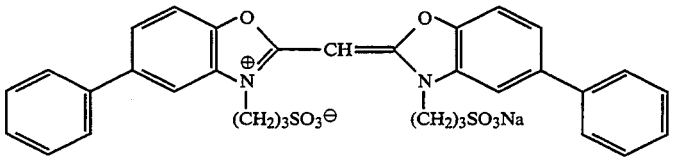
HS-1
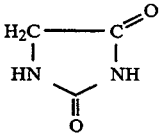
HS-2
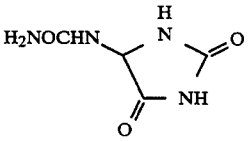

-continued
SC-1
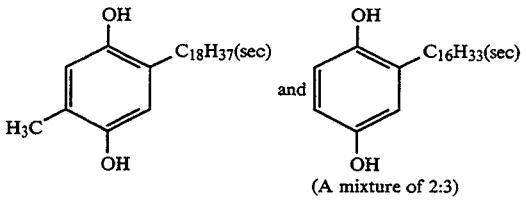
Oil-1
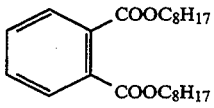
Oil-2
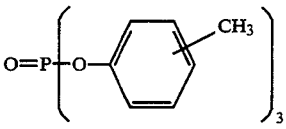
Oil-3
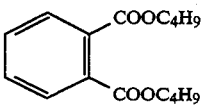
H-1
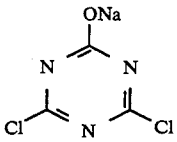
H-2
$(CH_2{=}CHSO_2CH_2)_2O$
SU-1
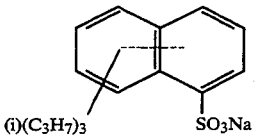
SU-2
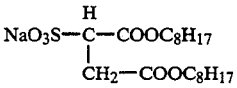
AI-1
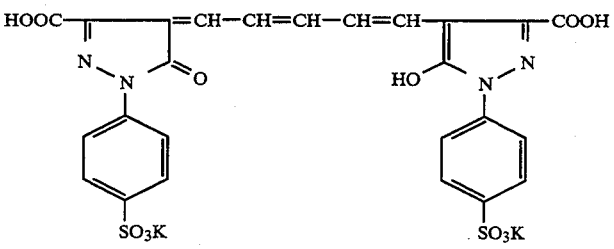
AI-2
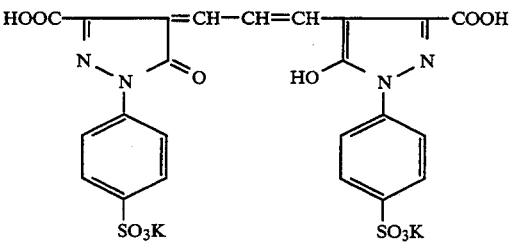

-continued

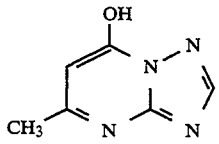

ST-1

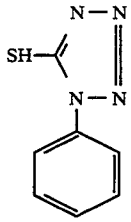

AF-1

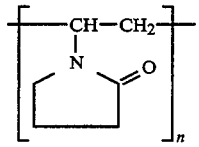

AF-2

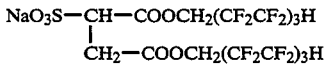

Compound F

The above-mentioned light sensitive materials further contained the following components; namely, compounds Su-1 and Su-2, a viscosity controller, layer hardeners H-1 and H-2, stabilizer ST-1, antifoggants AF-1 and AF-2 (having the weight average molecular weights of 10,000 and 1,100,000), dyes AI-1 and AI-2 and compound DI-1 (in an amount of 9.4 mg/m$^2$), respectively.

DI-1 (A mixture of the following 3 components)

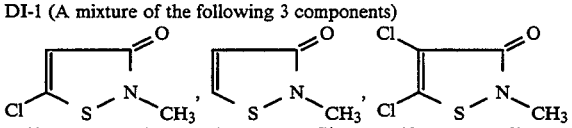

(Component A) (Component B) (Component C)

Components A:B:C = 50:46:4 (in the mole ratio)

The resulting samples 1 through 35 were each cut into a size of 35 mm×117 cm and it was checked up whether each of these cut pieces could be stored in a cartridge having an inner diameter of 18 mm. The results thereof are indicated by a mark O when it was stored in the cartridge and by X when it could not be stored therein.

Also, the samples 1 through 35 were further prepared and were then each cut into a size of 35 mm×117 cm. The resulting cut pieces were stored in the (current type of) cartridges having an inner diameter of 22 mm and were each subjected to forced aging tests (at 55° C. for one day) while keeping them in the state where they were so fixed as not to be rotated by a rotation stopper, respectively. After that, the rotation stopper was removed and a backing layer in a velvet portion was sprinkled with a suitable amount of sands. The samples were then stored in FT-1 produced by Konica Corp and the subject light sensitive materials were fully taken up, respectively. Next, the light sensitive materials were developed in the following processing steps and the resulting pressure-fog production thereon were evaluated.

How to evaluate the pressure-fog production:

The yellow density of the resulting line-formed fog and the density in the not-scratched portion were measured by a microdensitometer, so that the density difference ΔD was obtained and the evaluations were made in the following evaluation grades.

O : ΔD=0 to 0.06

Δ : ΔD=0.06 to 0.12

X : ΔD=0.13 to 0.19

XX : ΔD=Not less than 0.20

The kinematic friction coefficients of the outermost backing layer and the outermost emulsion layer each of the samples to the velvets were measured by making use of a 1 cm$^2$ sized Nylon-made velvet under the conditions of a 100 g load applied and a frictional sliding speed of 10 cm/min; (provided, the temperature and humidity were kept at 23° C. and 55%RH, respectively.)

A light-shielding member consisting of pile (material: nylon 66, young's modulus: 200 kg/mm$^2$, thickness: 100 D/48F, filament density: 36500 filaments/cm$^2$) and a rayon foundation was glued on a cartridge slit through which a film passes. For gluing, the method disclosed in Japanese Patent Application No. 75207/1985 was employed. The width of the cartridge slit through which a film passes was set to 2.2 mm and the height of the light-shielding member was set to 1.5 mm.

The results thereof are shown in Table-2.

| | Processing steps | | |
|---|---|---|---|
| Processing step | Processing time | Processing temperature | Replenishing amount |
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 1 min. | 55 ± 5.0° C. | — |

The amount replenished were each indicated by a value per sq.meter of a light sensitive material used. The color developing solution, bleaching solution, fixing solution, stabilizing solution and the replenishing solutions thereof used therein were as follows.

| Color developing solution | |
|---|---|
| Water | 800 ml |
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxylethyl) aniline sulfate | 4.5 g |
| Diethylene triamine pentaacetic acid | 3.0 g |
| Potassium hydroxide | 1.2 g |
| Add water to make | 1 liter |
| Adjust pH with potassium hydroxide or a 20% sulfuric acid solution to be | pH 10.06 |
| **Replenishing solution for the color developing solution** | |
| Water | 800 ml |
| Potassium carbonate | 35 g |
| Sodium hydrogen carbonate | 3 g |
| Potassium sulfite | 5 g |
| Sodium bromide | 0.4 g |
| Hydroxylamine sulfate | 3.1 g |
| 4-amino-3-methyl-N-ethyl-N-(β-hydroxylethyl) aniline sulfate | 6.3 g |
| Potassium hydroxide | 2 g |
| Diethylene triamine pentaacetic acid | 3.0 g |
| Add water to make | 1 liter |
| Adjust pH with potassium hydroxide or a 20% sulfuric acid solution to be | pH 10.18 |
| **Bleaching solution** | |
| Water | 700 ml |
| Iron (III) ammonium 1,3-diaminopropane tetraacetate | 125 g |
| Ethylenediamine tetraacetic acid | 2 g |
| Sodium nitrate | 40 g |
| Ammonium bromide | 150 g |
| Glacial acetic acid | 40 g |
| Add water to make | 1 liter |
| Adjust pH with aqueous ammonia or glacial acetic acid to be | pH 4.4 |
| **Replenishing solution for the bleaching solution** | |
| Water | 700 ml |
| Iron (III) ammonium 1,3-diaminopropane tetraacetate | 175 g |
| Ethylenediamine tetraacetic acid | 2 g |
| Sodium nitrate | 50 g |
| Ammonium bromide | 200 g |
| Glacial acetic acid | 56 g |
| Adjust pH with aqueous ammonia or glacial acetic acid to be | pH 4.0 |
| Add water to make finally | 1 liter |
| **Fixing solution** | |
| Water | 800 ml |
| Ammonium thiocyanate | 120 g |
| Sodium sulfite | 15 g |
| Ethylenediamine tetraacetic acid | 2 g |
| Adjust pH with aqueous ammonia or glacial acetic acid to be | pH 6.2 |
| Add water to make finally | 1 liter |
| **Replenishing solution for the fixing solution** | |
| Water | 800 ml |
| Ammonium thiocyanate | 150 g |
| Ammonium thiosulfate | 180 g |
| Sodium sulfite | 20 g |
| Ethylenediamine tetraacetic acid | 2 g |
| Adjust pH with aqueous ammonia or glacial acetic acid to be | pH 6.5 |
| Add water to make finally | 1 liter |
| **Stabilizing solution and the replenishing solution for the stabilizing solution** | |
| Water | 900 ml |
| 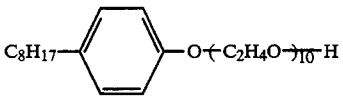 | 2.0 g |
| Dimethylol urea | 0.5 g |
| Hexamethylene tetramine | 0.2 g |
| 1,2-benzisothiazoline-3-one | 0.1 g |
| Siloxane (L-77 produced by UCC) | 0.1 g |
| Aqueous ammonia | 0.5 ml |
| Add water to make | 1 liter |
| Adjust pH with aqueous ammonia or a 50% sulfuric acid solution to be | pH 8.5 |

TABLE 1

| Sample No. | Thickness of support (μm) | Kinetic friction coefficient: Emulsion layer side | Kinetic friction coefficient: Backing layer side | Compound contained in protective layer | Compound contained in backing layer | Storability to cartridge | Pressure fog | Remarks |
|---|---|---|---|---|---|---|---|---|
| 1 | 120 | 0.39 | 0.38 | — | — | x | — | Comparison |
| 2 | 100 | 0.39 | 0.38 | — | — | x | — | Coqmrison |
| 3 | 90 | 0.39 | 0.38 | — | — | ∘ | xx | Comparison |
| 4 | 80 | 0.39 | 0.38 | — | — | ∘ | xx | Comparison |
| 5 | 70 | 0.39 | 0.38 | — | — | ∘ | xx | Comparison |
| 6 | 120 | 0.23 | 0.38 | A-9 | — | x | — | Comparison |
| 7 | 100 | 0.23 | 0.38 | A-9 | — | x | — | Comparison |
| 8 | 90 | 0.23 | 0.38 | A-9 | — | ∘ | x | Comparison |
| 9 | 80 | 0.23 | 0.38 | A-9 | — | ∘ | x | Comparison |
| 10 | 70 | 0.23 | 0.38 | A-9 | — | ∘ | x | Comparison |
| 11 | 120 | 0.39 | 0.22 | — | B-2 | x | — | Comparison |
| 12 | 100 | 0.39 | 0.22 | — | B-2 | x | — | Comparison |
| 13 | 90 | 0.39 | 0.22 | — | B-2 | ∘ | x | Comparison |
| 14 | 80 | 0.39 | 0.22 | — | B-2 | ∘ | x | Comparison |
| 15 | 70 | 0.39 | 0.22 | — | B-2 | ∘ | x | Comparison |
| 16 | 120 | 0.23 | 0.22 | A-10 | B-14 | x | — | Comparison |
| 17 | 100 | 0.23 | 0.22 | A-10 | B-14 | x | — | Comparison |
| 18 | 90 | 0.23 | 0.22 | A-10 | B-14 | ∘ | ∘ | Invention |
| 19 | 80 | 0.23 | 0.22 | A-10 | B-14 | ∘ | ∘ | Invention |
| 20 | 70 | 0.23 | 0,22 | A-10 | B-14 | ∘ | ∘ | Invention |
| 21 | 120 | 0.22 | 0.22 | A-62 | B-20 | x | — | Comparison |
| 22 | 100 | 0.22 | 0.22 | A-62 | B-20 | x | — | Comparison |
| 23 | 90 | 0.22 | 0.22 | A-62 | B-20 | ∘ | ∘ | Invention |
| 24 | 80 | 0.22 | 0.22 | A-62 | B-20 | ∘ | ∘ | Invention |
| 25 | 70 | 0.22 | 0.22 | A-62 | B-20 | ∘ | ∘ | Invention |
| 26 | 120 | 0.23 | 0.23 | A-74 | B-75 | x | — | Comparison |
| 27 | 100 | 0.23 | 0.23 | A-74 | B-75 | x | — | Comparison |
| 28 | 90 | 0.23 | 0.23 | A-74 | B-75 | ∘ | ∘ | Invention |

TABLE 1-continued

| Sample No. | Thickness of support (μm) | Kinetic friction coefficient: Emulsion layer side | Kinetic friction coefficient: Backing layer side | Compound contained in protective layer | Compound contained in backing layer | Storability to cartridge | Pressure fog | Remarks |
|---|---|---|---|---|---|---|---|---|
| 29 | 80 | 0.23 | 0.23 | A-74 | B-75 | ○ | ○ | Invention |
| 30 | 70 | 0.23 | 0.23 | A-74 | B-75 | ○ | ○ | Invention |
| 31 | 120 | 0.27 | 0.28 | B-75 | A-74 | x | — | Comparison |
| 32 | 100 | 0.27 | 0.28 | B-75 | A-74 | x | — | Comparison |
| 33 | 90 | 0.27 | 0.28 | B-75 | A-74 | ○ | Δ | Invention |
| 34 | 80 | 0.27 | 0.28 | B-75 | A-74 | ○ | Δ | Invention |
| 35 | 70 | 0.27 | 0.28 | B-75 | A-74 | ○ | Δ | Invention |

As is obvious from Table-1, it was found that a film cannot be stored in a cartridge having an inner diameter of 18 mm, unless the film has a support having a thickness of not thicker than 90 μm. With a sample comprising a support having a thickness of not thicker than 90 μm, it was proved to be unable to put any sample to practical use when the outermost backing layer and the outermost layer on the emulsion layer side of the sample have each a kinetic friction coefficient greater than 0.33 to the velvets, because such a sample produces many pressure fogs. On the contrary, it was found that the above-mentioned pressure fog production could particularly be improved when the samples contain organopolysiloxane in the outermost protective layer on the emulsion layer side and also contain a higher aliphatic acid (or the salts thereof) or an aliphatic ester in the outermost backing layer.

Example 2

Samples 36 through 56 were each prepared in the same manner as in Example 1; provided, the thicknesses of the supports, the kinetic friction coefficients of the sample surfaces to the velvets and the exemplified compounds A and B used therein were changed as shown in Table-2.

The resulting samples were stored in the cartridges having an inner diameter shown in Table-2. The flaw resistance and perforation-breakage of the samples were evaluated in the following measuring methods and the pressure fogs produced after developments were also evaluated in the same manner as in Example 1.

A light-shielding member consisting of pile (material: nylon 66, young's modulus: 200 kg/mm$^2$, thickness: 100 D/48F, filament density: 36500 filaments/cm$^2$) and a rayon foundation was glued on a cartridge slit through which a film passes. For gluing, the method disclosed in Japanese Patent Application No. 75207/1985 was employed. The width of the cartridge slit through which a film passes was set to 2.2 mm and the height of the light-shielding member was set to 1.5 mm.

Measurement of flaw resistance

A 35 mm×117 cm sized film (for 24 exposures) was stored in a cartridge having an inner diameter shown in Table-2 and was then subjected to a forced aging test (at 55° C. for one day long). After that, the backing layer side of the film was sprinkled over the velvet portion of a cartridge with a suitable amount of sands and the film was then pulled out at a rate of 20 cm/second. The resulting flaws produced on the backing layer surface of the film were evaluated in the following evaluation grades.

Evaluation grades of flaw resistance:

O : No flaw found at all,

Δ : Slight flaws found, and

X : Serious flaws found.

Measurement of perforation breakage

A 35 mm×117 cm sized film (for 24 exposures) was stored in a cartridge having an inner diameter shown in Table-2 and was then subjected to a forced aging test (at 55° C. for one day long). After that, the film was then pulled out at a rate of 50 cm/second. The resulting perforation breakage were evaluated in the following evaluation grades.

Evaluation grades of perforation breakage:

O : No breakage found at all,

Δ : Breakage found in some portions, and

X : Serious breakage found.

TABLE 2

| Sample No. | Thickness of support (μm) | Kinetic friction coefficient: Emulsion layer side | Kinetic friction coefficient: Backing layer side | Compound contained in protective layer | Compound contained in backing layer | Inner diameter of cartridge (mm) | Flaw resistance | Perforation breakage | Pressure fog |
|---|---|---|---|---|---|---|---|---|---|
| 36 (Comp.) | 90 | 0.39 | 0.38 | — | — | 22 | ○ | ○ | xx |
| 37 (Comp.) | 90 | 0.39 | 0.38 | — | — | 20 | Δ | Δ | xx |
| 38 (Comp.) | 90 | 0.39 | 0.38 | — | — | 18 | x | x | xx |
| 39 (Comp.) | 90 | 0.39 | 0.38 | — | — | 16 | x | x | xx |
| 40 (Inv.) | 90 | 0.24 | 0.23 | A-35 | B-10 | 22 | ○ | ○ | ○ |
| 41 (Inv.) | 90 | 0.24 | 0.23 | A-35 | B-10 | 20 | ○ | ○ | ○ |
| 42 (Inv.) | 90 | 0.24 | 0.23 | A-35 | B-10 | 18 | ○ | ○ | ○ |
| 44 (Inv.) | 90 | 0.24 | 0.23 | A-35 | B-10 | 16 | ○ | ○ | ○ |
| 45 (Inv.) | 90 | 0.22 | 0.24 | A-48 | B-45 | 22 | ○ | ○ | ○ |
| 46 (Inv.) | 90 | 0.22 | 0.24 | A-48 | B-45 | 20 | ○ | ○ | ○ |
| 47 (Inv.) | 90 | 0.22 | 0.24 | A-48 | B-45 | 18 | ○ | ○ | ○ |
| 48 (Inv.) | 90 | 0.22 | 0.24 | A-48 | B-45 | 16 | ○ | ○ | ○ |
| 49 (Inv.) | 90 | 0.23 | 0.23 | A-74 | B-81 | 22 | ○ | ○ | ○ |
| 50 (Inv.) | 90 | 0.23 | 0.23 | A-74 | B-81 | 20 | ○ | ○ | ○ |
| 51 (Inv.) | 90 | 0.23 | 0.23 | A-74 | B-81 | 18 | ○ | ○ | ○ |
| 52 (Inv.) | 90 | 0.23 | 0.23 | A-74 | B-81 | 16 | ○ | ○ | ○ |
| 53 (Inv.) | 90 | 0.28 | 0.27 | B-81 | A-74 | 22 | Δ | Δ | Δ |
| 54 (Inv.) | 90 | 0.28 | 0.27 | B-81 | A-74 | 20 | Δ | Δ | Δ |
| 55 (Inv.) | 90 | 0.28 | 0.27 | B-81 | A-74 | 18 | Δ | Δ | Δ |

TABLE 2-continued

| Sample No. | Thickness of support (μm) | Kinetic friction coefficient: Emulsion layer side | Kinetic friction coefficient: Backing layer side | Compound contained in protective layer | Compound contained in backing layer | Inner diameter of cartridge (mm) | Flaw resistance | Perforation breakage | Pressure fog |
|---|---|---|---|---|---|---|---|---|---|
| 56 (Inv.) | 90 | 0.28 | 0.27 | B-81 | A-74 | 16 | Δ | Δ | Δ |

Comp.: Comparison
Inv.: Invention

As is obvious from Table-2, it was proved that the excellent evaluation of the flaw resistance, perforation breakage and pressure fog production could be obtained when adding the lubricants [namely, organopolysiloxane to the outermost protective layer on the emulsion layer side and a higher aliphatic acid (or the salts thereof) or an aliphatic ester to the outermost backing layer] to the both sides of the sample of the invention.

Example 3

Samples 57 through 81 were each prepared in the same manner as in Example 1; provided, the thicknesses of the supports, the kinetic friction coefficients of the sample surfaces to the velvets and the exemplified compounds A and B used therein were changed as shown in Table-3.

The flaw resistance, perforation breakage and pressure fog production of the resulting samples were evaluated in the same evaluation methods as in Example 2.

.A light-shielding member consisting of pile (material: nylon 66, young's modulus: 200 kg/mm$^2$, thickness: 100 D/48F, filament density: 36500 filaments/cm$^2$) and a rayon foundation was glued on a cartridge slit through which a film passes. For gluing, the method disclosed in Japanese Patent Application No. 75207/1985 was employed. The width of the cartridge slit through which a film passes was set to 2.2 mm and the height of the light-shielding member was set to 1.5 mm.

The results thereof are shown in Table-3.

TABLE 3

| Sample No. | Thickness of support (μm) | Kinetic friction coefficient: Emulsion layer side | Kinetic friction coefficient: Backing layer side | Compound contained in protective layer | Compound contained in backing layer | Flaw resistance | Perforation breakage | Pressure fog |
|---|---|---|---|---|---|---|---|---|
| 57 (Comp.) | 90 | 0.39 | 0.38 | — | — | x | x | xx |
| 58 (Comp.) | 80 | 0.39 | 0.38 | — | — | x | x | xx |
| 59 (Comp.) | 70 | 0.39 | 0.38 | — | — | xx | xx | xx |
| 60 (Comp.) | 60 | 0.39 | 0.38 | — | — | xx | xx | xx |
| 61 (Comp.) | 50 | 0.39 | 0.38 | — | — | xx | xx | xx |
| 62 (Comp.) | 90 | 0.36 | 0.23 | — | B-26 | Δ | Δ | x |
| 63 (Comp.) | 80 | 0.36 | 0.23 | — | B-26 | Δ | Δ | x |
| 64 (Comp.) | 70 | 0.36 | 0.23 | — | B-26 | Δ | Δ | x |
| 65 (Comp.) | 60 | 0.37 | 0.23 | — | B-26 | Δ | x | x |
| 66 (Comp.) | 50 | 0.37 | 0.23 | — | B-26 | Δ | x | x |
| 67 (Comp.) | 90 | 0.22 | 0.37 | A-11 | — | Δ | Δ | x |
| 68 (Comp.) | 80 | 0.22 | 0.37 | A-11 | — | Δ | Δ | x |
| 69 (Comp.) | 70 | 0.22 | 0.37 | A-11 | — | Δ | Δ | x |
| 70 (Comp.) | 60 | 0.22 | 0.37 | A-11 | — | Δ | x | x |
| 71 (Comp.) | 50 | 0.22 | 0.38 | A-11 | — | Δ | x | x |
| 72 (Inv.) | 90 | 0.22 | 0.23 | A-54 | B-82 | ○ | ○ | ○ |
| 73 (Inv.) | 80 | 0.22 | 0.23 | A-54 | B-82 | ○ | ○ | ○ |
| 74 (Inv.) | 70 | 0.22 | 0.23 | A-54 | B-82 | ○ | ○ | ○ |
| 75 (Inv.) | 60 | 0.22 | 0.23 | A-54 | B-82 | ○ | ○ | ○ |
| 76 (Inv.) | 50 | 0.22 | 0.23 | A-54 | B-82 | ○ | ○ | ○ |
| 77 (Inv.) | 90 | 0.27 | 0.28 | B-82 | A-54 | Δ | Δ | Δ |
| 78 (Inv.) | 80 | 0.27 | 0.28 | B-82 | A-54 | Δ | Δ | Δ |
| 79 (Inv.) | 70 | 0.27 | 0.28 | B-82 | A-54 | Δ | Δ | Δ |
| 80 (Inv.) | 60 | 0.27 | 0.28 | B-82 | A-54 | Δ | Δ | Δ |
| 81 (Inv.) | 50 | 0.27 | 0.28 | B-82 | A-54 | Δ | Δ | Δ |

Comp.: Comparison
Inv.: Invention

As is obvious from Table-3, it was proved that the flaw resistance could be excellent, any perforation breakage could be eliminated and any pressure fog could not be produced, because the outermost layers on the both sides of the samples of the invention have a kinetic friction coefficient of not greater than 0.33 to the velvet. On the other hand, it was also proved that, when the outermost layer on one side of every sample has a kinetic friction coefficient of not greater than 0.33, the flaw resistance could not fully be displayed and the evaluation of the both perforation breakage and pressure fog production could not be satisfactory.

Example 4

Samples 82 through 102 were each prepared in the same manner as in Example 1; provided, the thickness of the supports were changed to be 90 μm, and the kinematic friction coefficients of the sample surfaces and the kinds and amounts of exemplified compounds A and B used therein were also changed as shown in Table-4.

The flaw resistance, perforation breakage and pressure fog production of the resulting samples were evaluated in the same evaluation methods as in Examples 1 and 2. The results thereof are shown in Table-4.

TABLE 4

| Sample No. | Thickness of support (μm) | Kinetic friction coefficient: Emulsion layer side | Kinetic friction coefficient: Backing layer side | Compound contained in protective layer: King | Compound contained in protective layer: Quantity (g) | Compound contained in backing layer: King | Compound contained in backing layer: Quantity (g) | Flaw resistance | Perforation breakage | Pressure fog |
|---|---|---|---|---|---|---|---|---|---|---|
| 82 (Comp.) | 90 | 0.38 | 0.37 | — | — | — | — | x | x | xx |
| 83 (Comp.) | 90 | 0.24 | 0.37 | A-1 | 1 | — | — | Δ | Δ | x |
| 84 (Comp.) | 90 | 0.38 | 0.23 | — | — | B-1 | 0.04 | Δ | Δ | x |
| 85 (Inv.) | 90 | 0.24 | 0.23 | A-1 | 1 | B-2 | 0.04 | ○ | ○ | ○ |
| 86 (Inv.) | 90 | 0.23 | 0.21 | A-1 | 2 | B-2 | 0.08 | ○ | ○ | ○ |
| 87 (Inv.) | 90 | 0.22 | 0.20 | A-1 | 3 | B-2 | 0.12 | ○ | ○ | ○ |
| 88 (Inv.) | 90 | 0.24 | 0.24 | A-47 | 1 | B-20 | 0.04 | ○ | ○ | ○ |
| 89 (Inv.) | 90 | 0.23 | 0.23 | A-47 | 2 | B-20 | 0.08 | ○ | ○ | ○ |
| 90 (Inv.) | 90 | 0.22 | 0.21 | A-47 | 3 | B-20 | 0.12 | ○ | ○ | ○ |
| 91 (Inv.) | 90 | 0.23 | 0.23 | A-52 | 1 | B-49 | 0.04 | ○ | ○ | ○ |
| 92 (Inv.) | 90 | 0.22 | 0.22 | A-52 | 2 | B-49 | 0.08 | ○ | ○ | ○ |
| 93 (Inv.) | 90 | 0.22 | 0.22 | A-52 | 3 | B-49 | 0.12 | ○ | ○ | ○ |
| 94 (Inv.) | 90 | 0.22 | 0.23 | A-61 | 1 | B-80 | 0.04 | ○ | ○ | ○ |
| 95 (Inv.) | 90 | 0.21 | 0.21 | A-61 | 2 | B-80 | 0.08 | ○ | ○ | ○ |
| 96 (Inv.) | 90 | 0.19 | 0.20 | A-61 | 3 | B-80 | 0.12 | ○ | ○ | ○ |
| 97 (Inv.) | 90 | 0.22 | 0.22 | A-66 | 1 | B-81 | 0.04 | ○ | ○ | ○ |
| 98 (Inv.) | 90 | 0.21 | 0.21 | A-66 | 2 | B-81 | 0.08 | ○ | ○ | ○ |
| 99 (Inv.) | 90 | 0.20 | 0.20 | A-66 | 3 | B-81 | 0.12 | ○ | ○ | ○ |
| 100 (Inv.) | 90 | 0.27 | 0.28 | B-81 | 1 | A-66 | 0.04 | Δ | Δ | Δ |
| 101 (Inv.) | 90 | 0.27 | 0.28 | B-81 | 2 | A-66 | 0.08 | Δ | Δ | Δ |
| 102 (Inv.) | 90 | 0.27 | 0.28 | B-81 | 3 | A-66 | 0.12 | Δ | Δ | Δ |

Comp.: Comparison.
Inv.: Invention

As is obvious from Table-4, it was proved that, when changing the amounts of exemplified compounds A and B used therein, the kinematic friction coefficients of the sample surfaces could be made smaller and the more excellent effects on the flaw resistance and the prevention of perforation breakage and pressure fog production could also be displayed.

What is claimed is:

1. A color photographic product having a patrone and a silver halide color photographic material rolled in said patrone, said silver halide color photographic material comprising;

a support having a thickness not exceeding 90 microns, a backing layer on a first face of said support, and a silver halide emulsion layer and a protective layer on a second face of said support, wherein an outermost layer on each of said first face and said second face has a maximum coefficient of kinetic friction of 0.33 with respect to velvet attached to an opening of said patrone through which said material passes, and wherein said outermost layer on said second face contains an organopolysiloxane, and said backing layer contains at least one compound represented by Formula (1) or Formula (2)

Formula (1)

RCOOM wherein R represents an aliphatic hydrocarbon group and M represents a cation;

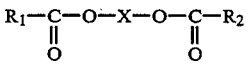

Formula (2)

wherein $R_1$ and $R_2$ each represents an aliphatic hydrocarbon group and X represents a divalent linkage group.

2. The product of claim 1, wherein said organopolysiloxane has a structural unit represented by the Formula (3),

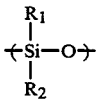

Formula (3)

wherein $R_1$ represents a hydrogen atom, a hydroxyl group or an organic group, $R_2$ represents an organic group.

3. The product of claim 2, wherein a terminal group is represented by Formula (4),

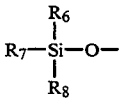

Formula (4)

wherein $R_6$, $R_7$ and $R_8$ represent each a hydrogen atom, a hydroxyl group or an organic group.

4. The product of claim 3, wherein the viscosity of said organopolysiloxane is within the range of 20 to 100000 centistokes measured at 25° C. and the molecular weight of said organopolysiloxane is within the range of 1000 to 1000000.

5. The product of claim 2 wherein a viscosity of said organopolysiloxane is 20 to 100,000 centistokes measured at 25° C., and a molecular weight of said organopolysiloxane is 1,000 to 1,000,000.

6. The product of claim 1, wherein a high-boiling organic solvent is contained in a substantially non-light-sensitive interlayer interposed between said protective layer and said silver halide emulsion layer.

7. The product of claim 1, wherein a thickness of said support is within the range of 50 μm to 90 μm.

8. The product of claim 7, wherein the thickness of said support is within the range of 60 μm to 80 μm.

9. The product of claim 1, wherein the kinetic friction coefficient is within the range of 0.10 to 0.30.

10. The product of claim 1, wherein the kinetic friction coefficient is within the range of 0.12 to 0.25.

11. The product of claim 1 wherein said backing layer contains said compound in an amount of 1 to 500 mg/m$^2$.

12. A color photographic product having a patrone and a silver halide color photographic material rolled in said patrone, said silver halide color photographic material comprising;

a support having a thickness not exceeding 90 microns, a backing layer on a first face of said support, and a silver halide emulsion layer and a protective layer on a second face of said support, wherein an outermost layer on each of said first face and said second face has a coefficient of kinetic friction of 0.33 or less with respect to velvet attached to an opening of said patrone through which said material passes, and wherein said outermost layer on said second face contains an organopolysiloxane, and said backing layer contains at least one compound selected from the group consisting of compounds represented by Formulas B-15 to B-97:

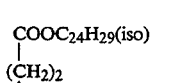
B-15

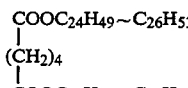
B-16

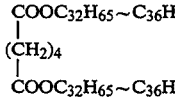
B-17

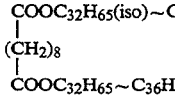
B-18

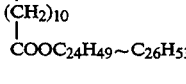
B-19

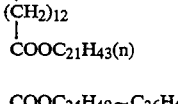
B-20

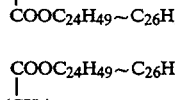
B-21

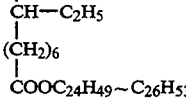
B-22

-continued

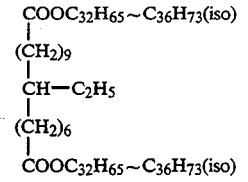
B-23

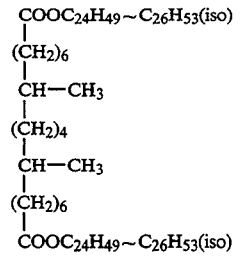
B-24

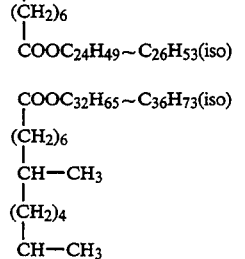
B-25

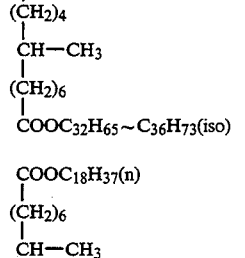
B-26

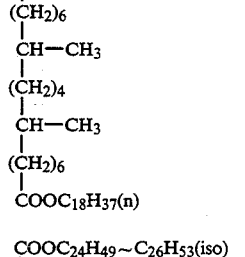
B-27

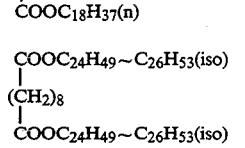
B-28

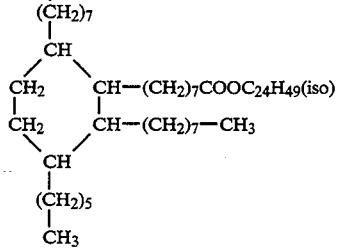
B-29

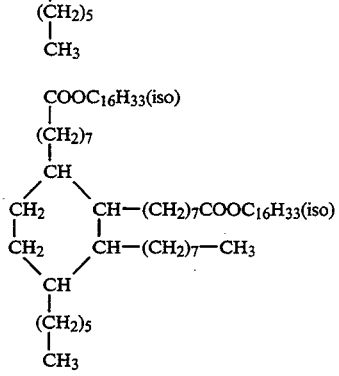

-continued

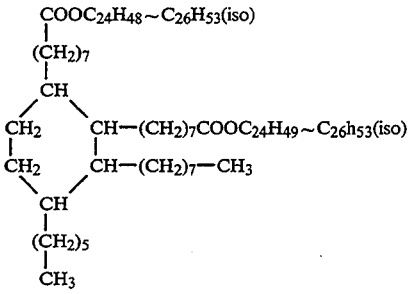

B-30

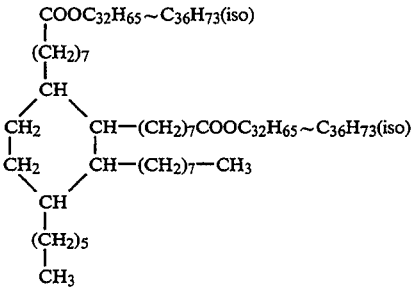

B-31

(iso)$C_{17}H_{35}COO(CH_2)_{14}OOCC_{17}H_{35}$(iso) B-32

(iso)$C_{17}H_{35}COO(CH_2)_{20}OOCC_{17}H_{35}$(iso) B-33

(iso)$C_{17}H_{35}COO(CH_2)_2CH(CH_2)_2OOCC_{21}H_{43}$(n) B-34
| CH3

(n)$C_{21}H_{43}COO(CH_2CHO)_{20}OOCC_{21}H_{43}$(iso) B-35
| CH3

(iso)$C_{27}H_{55}COO(CH_2CHO)_4OOCC_{27}H_{55}$(iso) B-36
| CH3

(iso)$C_{17}H_{35}COOCH_2CH_2SCH_2CH_2OOCC_{27}H_{55}$(n) B-37

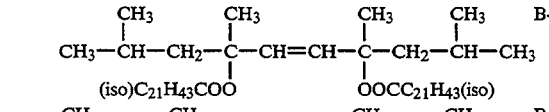

B-38

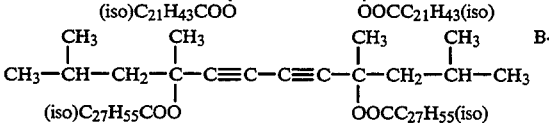

B-39

(iso)$C_{23}H_{47}COO(CH_2)_2OOCC_{23}H_{47}$(iso) B-40

(iso)$C_{15}H_{31}COO(CH_2)_6OOCC_{21}H_{43}$(n) B-41

(iso)$C_{31}H_{63}$~$C_{35}H_{71}COO(CH_2)_4OOCC_{31}H_{63}$~$C_{35}H_{71}$(iso) B-42

$CH_2OOCC_{15}H_{31}$(iso) B-43
| $CHOOCC_{15}H_{31}$(n)
| $CH_2OOCC_{15}H_{31}$(n)

$CH_2OOCC_{17}H_{35}$(iso) B-44
| $CHOOCC_{17}H_{35}$(iso)
| $CH_2OOCC_{17}H_{35}$(iso)

$CH_2OOCC_{17}H_{35}$(iso) B-45
| $CHOOCC_{17}H_{35}$(iso)
| $CH_2OOCC_{21}H_{55}$(n)

$CH_2OOCC_{17}H_{35}$(iso) B-46
| $CHOOCC_{17}H_{35}$(iso)
| $CH_2OOCC_{21}H_{43}$(n)

-continued $CH_2OOCC_{17}H_{35}$(iso) B-47
| $CH_3—CH_2—C—CH_2OOCC_{21}H_{43}$(n)
| $CH_2OOCC_{21}H_{43}$(n)

$CH_2OOCC_{17}H_{35}$(iso) B-48
| $CH_3—CH_2—C—CH_2OOCC_{17}H_{35}$(n)
| $CH_2OOCC_{27}H_{55}$(n)

$CH_2OOCC_{17}H_{35}$(iso) B-49
| (n)$C_{21}H_{43}COOCH_2—C—CH_2OOCC_{17}H_{35}$(iso)
| $CH_2OOCC_{21}H_{43}$(n)

$CH_2OOCC_{17}H_{35}$(iso) B-50
| (n)$C_{21}H_{43}COOCH_2—C—CH_2OOCC_{21}H_{43}$(iso)
| $CH_2OOCC_{21}H_{43}$(n)

(iso)$C_{17}H_{35}COOCH_2$-(CH)$_4$-$CH_2OOCC_{17}H_{35}$(iso) B-51
| $OOCC_{12}H_{25}$(n)

(iso)$C_{17}H_{35}COOCH_2$-(CH)$_4$-$CH_2OOCC_{17}H_{35}$(iso) B-52
| $OOCC_{17}H_{35}$(iso)

(n)$C_{21}H_{43}COOC_{18}H_{37}$(iso) B-53

(n)$C_{21}H_{43}COOC_{24}H_{49}$(iso) B-56

(iso)$C_{17}H_{35}COOC_{32}H_{65}$~$C_{36}H_{73}$(iso) B-57

(n)$C_{27}H_{55}COOC_{18}H_{37}$(iso) B-58

(n)$C_{17}H_{35}COOC_{32}H_{65}$~$C_{36}H_{73}$(iso) B-59

(n)$C_{21}H_{43}COOC_{16}H_{33}$(iso) B-60

(n)$C_{21}H_{43}COOC_{20}H_{41}$(iso) B-61

(n)$C_{21}H_{43}COOC_{24}H_{29}$(iso) B-62

(iso)$C_{17}H_{35}COOC_{50}H_{101}$(n) B-63

(iso)$C_{23}H_{47}COOC_{24}H_{49}$(iso) B-64

(iso)$C_{31}H_{63}$~$C_{35}H_{71}COOC_{18}H_{37}$(n) B-65

(n)$C_{27}H_{55}COOC_{24}H_{49}$(iso) B-66

(n)$C_{15}H_{31}COOC_{16}H_{33}$(n) B-67

(n)$C_{17}H_{35}COOC_{18}H_{37}$(n) B-68

$COOC_{32}H_{65}$~$C_{36}H_{73}$(iso) B-69
| $(CH_2)_{10}$
| $COOC_{32}H_{65}$~$C_{36}H_{73}$(iso)

$COOC_{16}H_{33}$(n) B-70
| $(CH_2)_{12}$
| $COOC_{21}H_{43}$(n)

$COOC_{18}H_{37}$(n) B-71
| $(CH_2)_2$
| $COOC_{18}H_{37}$(n)

$COOC_{16}H_{33}$(n) B-72
| $(CH_2)_4$
| $COOC_{16}H_{33}$(n)

$COOC_{12}H_{25}$(n) B-73
| $(CH_2)_8$
| $COOC_{12}H_{25}$(n)

$COOC_{21}H_{43}$(n) B-74
| $(CH_2)_2$
| O
| $(CH_2)_2$
| $COOC_{21}H_{43}$(n)

-continued $(n)C_{17}H_{35}COONa$ B-75

$(n)C_{21}H_{43}COOH$ B-76

$(n)C_{21}H_{43}COONa$ B-77

$(n)C_{21}H_{43}COOHN(C_2H_5)_3$ B-78

$(n)C_{21}H_{43}COON(C_2H_5)_4$ B-79

$(n)C_{27}H_{55}COOK$ B-80

$(iso)C_{23}H_{47}COOH$ B-81

$(n)C_{15}H_{31}COOHN(C_8H_{17})_3$ B-82

$(n)C_{17}H_{35}COOH$ B-83

$(iso)C_{17}H_{35}COO\frac{1}{2}Ca$ B-84

$C_{21}H_{41}COOK$ B-85

$C_{21}H_{43}COOHN(C_2H_4OH)_3$ B-86

$C_{17}H_{35}COO\frac{1}{2}Ba$ B-87

B-88

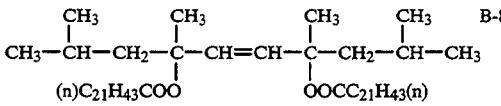

B-89

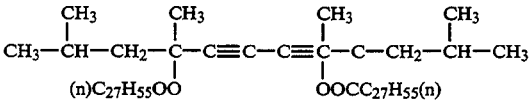

$(n)C_{17}H_{35}COO(CH_2)_2OOCC_{17}H_{35}(n)$ B-90

$(n)C_{21}H_{43}COO(CH_2CH_2O)_2OCC_{21}H_{43}(n)$ B-91

$(n)C_{15}H_{31}COO(CH_2)_4OOCC_{15}H_{31}(n)$ B-92

B-93

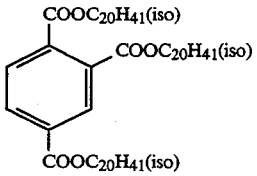

B-94

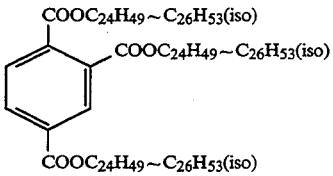

-continued

B-95

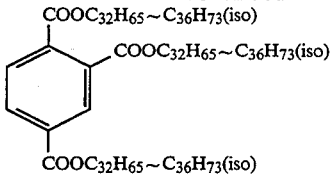

B-96

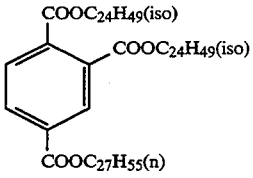

B-97

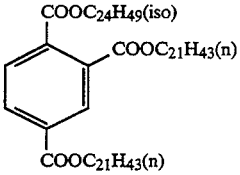

13. The silver halide color photographic material of claim 12, wherein a high-boiling organic solvent is contained in a substantially non-light-sensitive interlayer interposed between said protective layer and said silver halide emulsion layer.

14. The product of claim 12 wherein said backing layer contains said compound in an amount of 1 to 500 $mg/m^2$.

15. The product of claim 12 wherein said patrone has an inner diameter of 18 to 22 mm.

16. The product of claim 12 wherein said kinetic friction coefficient is 0.10 to 0.30.

17. The method of claim 12 wherein said support has a thickness of 50 $\mu m$ to 90 $\mu m$.

18. The product of claim 12 wherein said organopolysiloxane has a structural unit represented by Formula (3)

Formula (3)

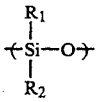

* * * * *